United States Patent [19]

Rosar et al.

[11] 3,973,734

[45] *Aug. 10, 1976

[54] FROTH FLOTATION PROCESS

[75] Inventors: Edward C. Rosar, Lakewood; John R. Hobaugh, Denver; Vuko M. Lepetic, Lakewood, all of Colo.

[73] Assignee: Industrial Resources, Inc., Chicago, Ill.

[ * ] Notice: The portion of the term of this patent subsequent to Apr. 23, 1992, has been disclaimed.

[22] Filed: Apr. 22, 1974

[21] Appl. No.: 462,725

Related U.S. Application Data

[63] Continuation-in-part of Ser. No. 190,416, Oct. 18, 1971, Pat. No. 3,806,044.

[52] U.S. Cl. ..... 241/20; 209/3; 209/166

[51] Int. Cl.[2] ..... B02C 21/00

[58] Field of Search ..... 209/166, 3; 208/11; 241/20, 24

[56] References Cited

UNITED STATES PATENTS

| | | | |
|---|---|---|---|
| 1,510,983 | 10/1924 | Dolbear | 209/166 X |
| 1,615,121 | 1/1927 | Fyleman | 208/11 |
| 1,820,917 | 9/1931 | Langford | 208/11 |
| 2,453,060 | 11/1948 | Bauer | 208/11 |
| 2,931,502 | 4/1960 | Schoeld | 209/166 |
| 3,516,787 | 6/1970 | Van Nordstrand | 208/11 X |
| 3,525,437 | 8/1970 | Garrett | 209/166 |
| 3,553,100 | 9/1968 | Jorda | 208/11 |
| 3,607,720 | 9/1971 | Paulson | 209/166 X |
| 3,623,971 | 11/1971 | Bowman | 208/11 |
| 3,806,044 | 4/1974 | Rosan | 209/3 |

FOREIGN PATENTS OR APPLICATIONS

| | | | |
|---|---|---|---|
| 19,231 | 9/1935 | Australia | 208/11 |
| 675,507 | 12/1963 | Canada | 208/11 |
| 680,576 | 2/1964 | Canada | 208/11 |
| 834,833 | 3/1952 | Germany | 209/166 |
| 205,406 | 9/1939 | Switzerland | 209/166 |

*Primary Examiner*—Robert Halper
*Attorney, Agent, or Firm*—Jacques M. Dulin

[57] ABSTRACT

Froth Flotation method of separation of sodium compounds, principally nahcolite, dawsonite, trona, related authigenic sodium ores, and corresponding sodium compounds including sodium carbonate and sodium bicarboate, from kerogen-type organics-containing rock, by use of sodium carbonate and/or sodium bicarbonate-containing brines having a basic pH ranging above about 7.0, preferably 8.0 – 12.0, and recovering a sodium compounds-rich fraction as a non-float portion, and an organics-rich fraction as a float portion. Frothers, froth control agents and collection agents may be used separately or in combination. Single or multiple-stage flotation, with cleaning, conditioning, scavenging, reflotation, and combining of products may be used. Feed ore and products may be screened to upgrade the head or product assay. By this method, raw or retorted oil shale may be separated from sodium minerals or compounds contained therein.

36 Claims, 1 Drawing Figure

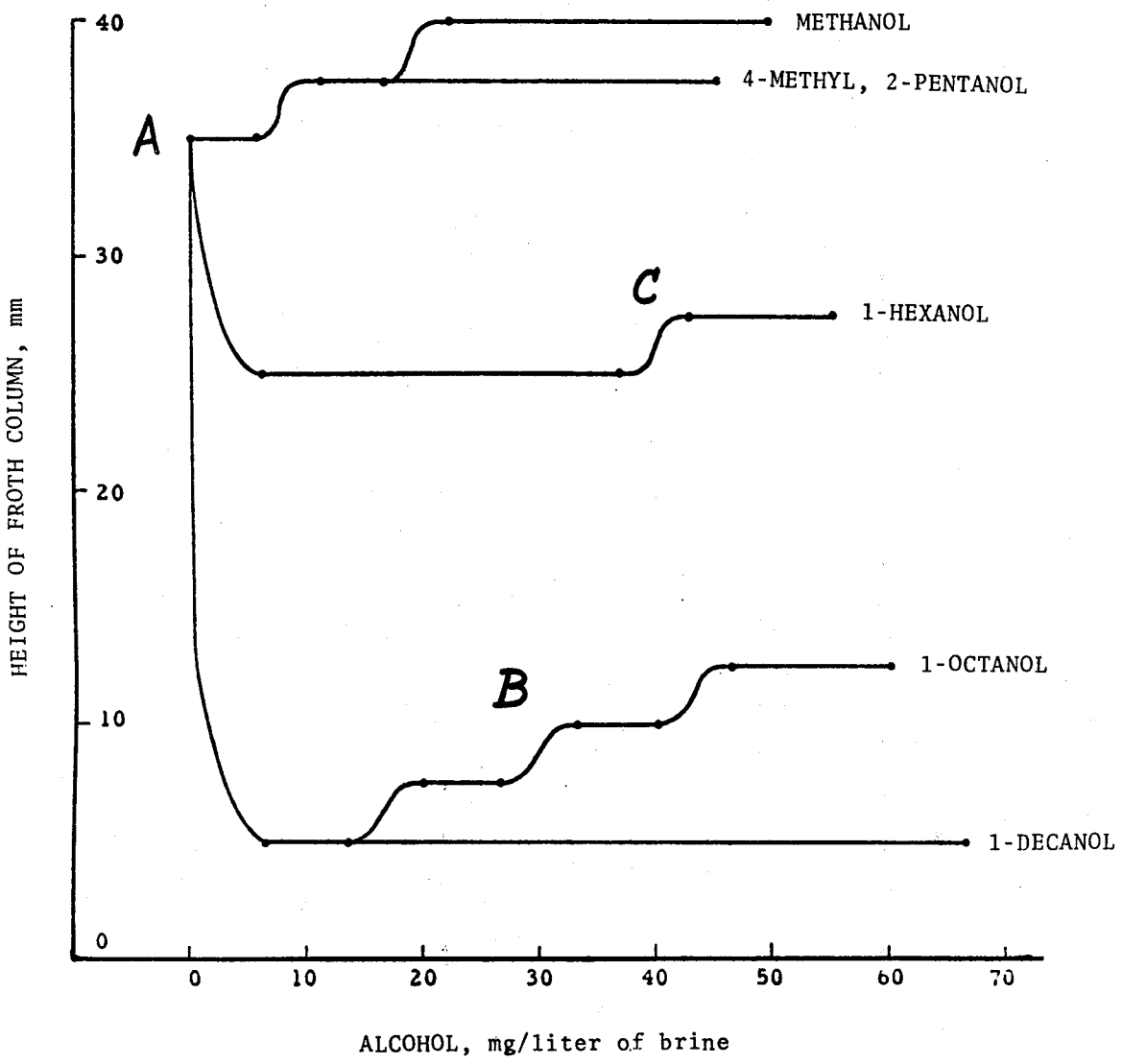
METHANOL
4-METHYL, 2-PENTANOL
A
C
1-HEXANOL
B
1-OCTANOL
1-DECANOL
HEIGHT OF FROTH COLUMN, mm
40
30
20
10
0
0
10
20
30
40
50
60
70
ALCOHOL, mg/liter of brine

FROTH FLOTATION PROCESS

CROSS-REFERENCE TO RELATED CASE

This application is a continuation-in-part of our copending application Ser. No. 190,416 filed Oct. 18, 1971, now U.S. Letters Pat. No. 3,806,044, issued Apr. 23, 1974, the disclosure of which is incorporated herewith by reference.

FIELD

This application relates to froth flotation methods employing sodium carbonate and/or sodium bicarbonate-containing brines having basic pH's for the separation of sodium compounds and sodium minerals from organics-containing rock. More particularly, the invention relates to use of such brines to float and recover raw, processed, or retorted oil shale from authigenic sodium minerals and/or corresponding sodium compounds, with such sodium minerals and/or compounds being recovered in a non-float portion.

BACKGROUND

Extensive formations of organic-bearing dolomitic marlstones exist throughout the western part of the United States, principally the mountain states of Colorado, Utah and Wyoming. This rock is ordinarily called "oil shale" since it contains considerable amounts of organic material termed "kerogen", which upon heating produces a hydrocarbon-type oil. The kerogen-bearing rocks occur in beds of varying oil content, with individual strata bearing as much as 75–95 gallons of shale oil per ton of rock ore.

According to the U.S. Bureau of Mines: "The term 'oil shale' as commonly used, covers a wide variety of laminated, solidified mixtures of argillaceous sediments and organic matter having the common property of yielding oil upon destructive distillation, yet being but slightly susceptible to the action of solvents." Therefore, the term oil shale, as used herein, is not restricted to the organic-bearing dolomitic marlstones of the Green River formation.

Such kerogen-bearing rock (oil shale) is found in the Green River formation of the Piceance Creek Basin in Northwestern Colorado. This formation extends into the Uinta Basin of Utah and the Washakie Basin of Wyoming. Various oil shale-bearing members of the Green River Formation contain strata with continuous sequences which assay from 10 to 50 G.P.T. It is these members which are of principal initial interest to the recent bonus bidders for federal oil shale leases in Colorado and Utah.

The kerogen-bearing rock (oil shale) in the Green River Formation also contains sodium mineralization. These authigenic sodium-containing minerals include, principally, nahcolite, trona and dawsonite, with other significant sodium-containing minerals including shortite and halite. Nahcolite is a natural, crystalline, generally transparent to whitish, sodium bicarbonate mineral. In the Piceance Creek Basin the nahcolite occurs in two basic ways: disseminated (intermingled) in the oil shale, ranging from minute crystals to "rosettes" occurring in sizes of from about ¼ inch to several feet in diameter, and in beds in the Saline Zone of the Parachute Creek member of the Green River Formation. The Saline Zone beds may range from 3–10′ in thickness, and assay as high as 95% $NaHCO_3$, with 30–90% being typical, the balance being oil shale rock and associated minerals. The Saline Zone itself ranges from 600–900′ thick in the Piceance Creek Basin and is estimated to contain recoverable reserves of 12,000 tons/acre bedded nahcolite, 194,000 tons/acre disseminated nahcolite, 37,000 tons/acre dawsonite, and 306,000 Bbl shale oil/acre. Nahcolite is useful as an $SO_x$ air pollution control sorbent, and as a feedstock for production of soda ash.

Dawsonite, $NaAlCO_3(OH)_2$, occurs disseminated in oil shale, and is also present in the Saline Zone in assays up to 30%, with dawsonite-enriched zones typically running 8–14%. Dawsonite can be converted initially to sodium aluminate, an air and water pollution control agent, and eventually to alumina, which like bauxite is a feedstock for aluminum production.

Trona, $Na_2CO_3 \cdot NaHCO_3 \cdot 2H_2O$, is also present in beds, principally in Wyoming. Small amounts (1–5%) of trona, thermonatrite $Na_2CO_3 \cdot H_2O$, and natron, $Na_2CO_3 \cdot 10H_2O$ may be present with nahcolite in the Piceance Creek Basin area of Northwestern Colorado. Trona is principally useful as a feedstock for production of soda ash.

In mining and processing nahcolite or trona for the sodium values, presence of oil shale is undesirable, lowering the run-of-mine sodium minerals assay, interfering with processing, and posing a disposal problem. Conversely, in the mining and processing of oil shale for the shale oil values, the presence of soluble sodium minerals is also undesirable. In extracting shale oil from the oil shale rock, retorting (heating) processes are employed. However, in some retorting processes, presence of minor quantities of sodium mineralization tends to combine with the silica, calcite, dolomite, feldspars, and gibbsite ($Al(OH)_3$) of the shale to form a glassy clinker that may plug the retort. In addition, the retorting converts dowsonite to sodium aluminate, and both nahcolite and trona to crude soda ash. All those materials in the retorted waste shale (processed oil shale rock) are water soluble. Disposal of the waste shale thus poses a serious water pollution problem since the soluble sodium values can leach from the shale, increasing ambient salinity. Since a mature oil shale industry would produce 13 billion tons of waste shale in about 30 years, even presence of only 1–5% of sodium minerals would contribute significantly to sodium alkalinity, if left unchecked.

One approach to these problems is multi-mineral development. This approach includes mining an oil shale of lower grade with respect to shale oil, but one that contains significant amounts of dawsonite and/or nahcolite. The minerals would be separated and each processed for their intrinsic values. In the Piceance Creek Basin the preferred mining would be underground in the Saline Zone of the Parachute Creek member, with all the waste disposed of by backfilling in the mine. A major problem to multi-mineral development is the lack of a relatively inexpensive, effective means of separating the nahcolite from the oil shale and dawsonite.

There exists, therefore, a need for a simple, relatively inexpensive, effective, controllable process for handling a wide variety of oil shale rock and sodium mineral-containing ores and separating the components from each other.

THE INVENTION

OBJECTS

It is an object of this invention to provide a method of separation of oil shale values from authigenic sodium minerals and corresponding sodium compounds values permitting selective recovery of one or both values.

It is an object of this invention to provide a froth flotation method of separation of kerogen-containing dolomitic marlstone or other oil shale types from authigenic sodium minerals and/or coresponding sodium compounds.

It is another object to provide a method of flotation of oil shale type rock in a float portion, and recovering sodium minerals and related compounds from a non-float portion.

It is another object to provide a froth flotation method of separation of kerogen-containing rock in a float portion from authigenic sodium minerals and corresponding or related sodium compounds in a non-float portion by use of aqueous sodium carbonate and/or bicarbonate-containing brines.

It is another object to provide a froth flotation method of separation of oil shale from authigenic sodium minerals, principally nahcolite, dawsonite, and trona, and/or corresponding sodium compounds employing brines in a basic pH range, preferably of about 8 – 12.

It is another object to provide a method of controlling the froth of aqueous sodium carbonate and/or sodium bicarbonate-containing brines by use of frothers and/or forth control agents.

It is another object to provide a froth flotation method of separation of oil shale from non-kerogen-containing minerals and/or compounds with the naturally produced froth generated from the brine pulp wherein no reagents are used.

It is another object to provide a froth flotation method of separation of oil shale from non-kerogen-containing minerals and/or compounds which optionally may use collection agents, alone or in combination with frothers and/or froth control agents.

It is another object to provide such a froth flotation process which optionally employs multiple flotation, cleaner flotation, scavenging, and product combination steps.

It is another object to provide a process of upgrading the kerogen and/or sodium values in the ore by pre- or post-flotation screening of the feed ore or product.

Still further objects will be evident from the description and drawing.

FIGURE

The description has reference to:

The FIGURE, which graphically illustrates the effect of froth control agents on brines of this invention.

SUMMARY AND GENERAL TEACHINGS

Ore of kerogen-containing dolomitic marlstone (oil shale) or other types of oil shales containing authigenic sodium minerals, principally nahcolite, dawsonite, and trona, is reduced to particles of flotation size as required by its liberation characteristics, with the fines forming the flotation head (feed). The head is pulped in an aqueous brine comprising a solution containing sodium carbonate and/or sodium bicarbonate, which brine solution has a basic pH above about 7.0, typically in the range of from about 8.0 – 12.0, preferably 8.3 – 11.6 and most preferably 8.7 – 10.3. The brine pH is defined with respect to the sodium carbonate and/or sodium bicarbonate content, and may contain other soluble salts of alkali metals and alkaline earth metals, such as sodium, lithium, potassium, or the like contributed to the brine solution from authigenic materials in the head ore. These include, principally, NaCl, KCl, $Na_2SO_4$ and the like. The brines of this invention include brines which may be substantially only $Na_2CO_3$ solutions, only $NaHCO_3$ solutions, or mixtures thereof, and include brines in equilibrium with respect to the soluble constituents of the ore at the temperature of the brine solution.

The pulped ore-brine mixture may contain 1–40% solids depending on the specific grade and type of ore, typically 5–30% solids, and preferably 15–25% solids. The percent solids typically decreases from the rougher in the cleaner and scavenger steps of the process of this invention. The same or different brines may be present in the rougher, cleaner and scavenger steps. Where it is preferred to maintain different brines throughout the flotation circuit, it may be necessary to dewater the separated fractions or portions, rinse them with water, and recycle the rinse water and salvaged brine, before forwarding on the fraction to the next flotation step.

After pulping, the ore solids may be conditioned, after which a flotation froth is formed by aeration and agitation of the brine. We have discovered that in such brines, the float portion carries off oil shale-rich rock which may also contain disseminated dawsonite and gibbsite, while the nahcolite, soda ash, and trona-type values are concentrated in the non-float portions and may be removed as a sodium minerals or compounds-rich underflow portion.

The process of this invention is simple in that conventional froth flotation equipment operated in standard procedures according to the parameters of this invention may be used. The process is applicable to single-stage flotation, as well as to multiple-stage flotation employing scavenger flotation of rougher tailings (float portions), cleaner flotation of rougher concentrate (non-float portions), and optionally selectively combining the separated float or non-float portions to produce a number of combined concentrates, rich in oil shale or nahcolite (and soda ash values, if any), respectively. The feed ore may be screened prior to flotation to upgrade the head with respect to a desired oil or sodium value. Likewise, the flotation products may be screened, with rejects refloated or reground and refloated.

The separated underflow nahcolite values may be filtered or rinsed and air dried to produce an $NaHCO_3$-rich concentrate product, or heat dried (calcined) to produce an $Na_2CO_3$-rich concentrate. By control of the temperature and time of the drying step, a mixed $NaHCO_3/Na_2CO_3$ product may be obtained. Drying temperatures may range from 100°F over 8–24 hours to produce a mixed product, to 250°F for 1 hour to produce an $Na_2CO_3$-rich product. Calcining may also occur as high as 500°–1200°F to vaporize or pyrolize residual organics resulting in a cleaner product, if desired. As used herein, the term "$Na_2O$ percent" or "$Na_2O$ content" refers collectively or individually to the sodium carbonate and/or sodium bicarbonate values of the recovered concentrated products represented as the oxide rather than as the carbonate (whether carbonate or bicarbonate) for the sake of simplicity and to give a uniform basis for comparison of recovery yields and efficiencies. Where shown, the total yield, expressed as $Na_2O$, may be broken down into yields, after drying for about 16 hours at 150°F, of the carbonate and bicarbonate product. It should be understood, however, that ambient air drying without heat would produce higher bicarbonate assays, while hotter drying or calcining will produce higher carbonate assays in the dried products.

The process of this invention also contemplates the optional use of collector reagents, frothers and froth control agents (froth suppressants) alson or in simultaneous or sequential combination. We have found that the brines of this invention are self-frothing without need of added froth producing agents (frothers) or collectors for nahcolite/oil shale ore.

We have also found that the oil shale, upon crushing and grinding, does not absolutely require a collection agent. While we do not wish to be bound by theory, we believe this may be due to nature organics (kerogen) present in the oil shale that provides a hydrophobic hydrocarbon coating on the oil shale particles, assisting in the flotation. This can, however, work to disadvantage in cases where the size reduction of the ore causes smearing or coating of the nahcolite, trona or other authigenic sodium mineral or corresponding compound sought to be separated from the oil shale rock ore. Excessive smearing tends to promote loss of such nahcolite values in the float portion, with attendant reduction in separation efficiency and yield. We, therefore, prefer size reduction by means that tends to reduce the smearing, e.g., by use of a hammer mill or the like, or cleaning of the nahcolite prior to or during the flotation. Size reduction may be accomplished by jaw crushers, gyratory crushers, rod and ball mills, roll crushers, impact crushers, cage mills, cone type crushers, and autogenous mills and the like.

In this regard, the invention may optionally use organic collector agents of a hydrophobic film-forming type that have a selective affinity for the oil shale particles, gangue, or other inclusion mineralization, such as iron sulfides, as distinct from the sodium mineralization. Examples of this generic class are aliphatic organic compounds, or mixtures, such as kerosene; fatty acids and their alkaline earth metal or alkali metal salts of those acids (fatty acid soaps); aromatic alcohols such as cresylic acid; organic amine or amine salt cationic collectors, such as Aeromine 3037 (a cationic amine), and the like. Any compound which promotes the collection of the oil shale-type values by providing a hydrophobic coating on the oil shale and/or gangue particles may be used. Such collectors are principally used where the oil assay is low, the shale ore is retorted or not fresh, the size reduction has not liberated a sufficient amount of hydrocarbons for self-collection, or the oil shale separation efficiency and yield needs to be increased. Collection agents in the amount of up to about 10 lbs/ton of ore head may be used, with up to 5 lbs being preferred where needed, as in the cases noted above.

Oil shales contain heavy metal sulfides, some of which are pyrite ($FeS_2$), marcasite ($FeS_2$), pyrrhotite ($Fe_{n-1}S_n$, $n = 5–16$), and wurtzite (ZnS). As an example, accumulations up to and over 1.0% pyrite exist in oil shale. When the oil shale is reduced in size, the metal sulfides are still primarily retained in the oil shale rock. Certain collectors in conjunction with the metal sulfides can be used as a levitation acid in the flotation of the oil shale. The exposed metal sulfides on the surface of the oil shale particles readily accept the collector and readily accept bubble attachment. Typical collectors which can be used include sulphydric acids, such as xanthates, among which are potassium ethyl xanthate, sodium ethyl xanthate, potassium n-butyl xanthate, and the like; thiophosphates, among which are Aerofloats 15, 25, 31, 239, 241, 242, 203, 208, 213, 226, 238, 239, 243, Sodium Aerofloat, Sodium Aerofloat B, and the like; mercaptans and thioalcohols, among which are thiocarbanilid, diphenyl thiocarbazid, mercaptobenzothiazole, dithiocarbamates and trithiocarbonates; organic sulfides, such as dixanthogen, thiuramdisulfides, thiophenes, and the like; carboxylic acids and corresponding salts compounds, among which are fatty acids and soaps, tall oil, and the like; and sulphoxy compounds.

Referring to the FIGURE, froth control agents optionally may be used. As seen from point A in the FIGURE, fresh brines with no frothers or froth control agents (suppressors), the brines defined herein are self-frothing in the flotation system of this invention. In many instances no froth control will be required. The FIGURE shows the effect of various frothers and froth control agents on the brine frothing, with the change in froth height being plotted as a function of amounts of various agents. The brine used in this test was prepared by addition of 162.5 g/l $NaHCO_3$, 5.28 g/l $Na_2CO_3 \cdot H_2O$, 1.06 g/l NaCl and 12.25 g/l $Na_2SO_4 \cdot 10H_2O$ to deionized water. This brine closely approximates a brine derived from ore ranging from 45.5–57% nahcolite, 1.0 – 1.5 $Na_2CO_3$ and 9.4 – 14.2 g/ton oil. As demonstrated in the FIGURE, we have found that low molecular weight, water-soluble alcohols, up to about $C_{5-6}$, increase the froth. In contrast, higher molecular weight alcohols of lower water solubility or higher insolubility, at least initially suppress froth formation. As the alcohol water solubility decreases (higher molecular weight or chain length), the flotation rate decreases, and total recovery of sodium mineralization in the underflow non-float portion increases.

The principal use of frothers is to decrease the surface tension of the liquid phase, promoting surface bubble formation and levitation of the oil shale and/or gangue particles for removal and concentration in the froth portion of the flotation system. For example, we have found that shorter chain alcohols, such as methanol, 4-methyl-2-pentanol (methyl isobutyl carbinol, MIBC), pine oil, and Aerofroth 73 (a water-soluble higher aliphatic alcohol) favor froth formation, while 1-hexanol, 1-octanol, and 1-decanol suppress, or initially suppress, natural froth formation. Thus, depending on the ore grade and quality, the head particle size and particle characteristics, including liberation size and natural hydrocarbon coating, such compounds which in the flotation system of this invention promote or suppress froth may be used in amounts up to about 5 lbs/ton of dry float feed (head ore).

We have also discovered that increasing the amounts of the above froth suppressants, such as 1-hexanol and 1-octanol, permit some additional froth formation. This is illustrated at B and C in the FIGURE. While we do not wish to be bound by theory, we presently believe that the initial additional of such alcohols does perform a dual function in affecting bubble formation, and cleaning the surface of the nahcolite or other sodium mineral or compound particles, thus permitting them to better be retained in the underflow, i.e., non-float portion. Increaased amounts then promote the formation of bubbles for the froth portion. Thus, a very precise control of the froth can be accomplished by adjustment of the brine composition, alone or in combination with frothers or froth control agents in various amounts in accord with the principles of this invention.

By the use of the term "ore", we include generally kerogen-bearing rock containing authigenic sodium minerals, whether the rock is raw, freshly mined or stock pile "aged", processed, or retorted. Our process is applicable to oil shale-rich ore or sodium minerals-rich ore, and permits the selective upgrading and recovery of one or both products: oil shale, or sodium minerals such as dawsonite, nahcolite, and trona. The process may be used for upgrading oil shale while removing the sodium values therefrom prior to retorting to reduce plugging in the retorts. Typically, oil shale mines for its shale oil content may run 10–45 gallons per ton on the average, with individual strata up to about 75–95 G.P.T. The nahcolite content in the 45 G.P.T. oil shale may run 0–30% by weight, with the dawsonite, $NaAlCO_3(OH)_2$, running 0–25% by weight. Conversely, Nahcolite ore may range from 0–95% $NaHCO_3$, typically 30–90%, and contain 0–25% dawsonite, and 0–30 G.P.T. shale oil. Sodium carbonate may be present as such or as trona, $Na_2CO_3 \cdot NaHCO_3 \cdot 2H_2O$, thermonatrite, $Na_2CO_3 \cdot H_2O$, and as natron, $Na_2CO_3 \cdot 10H_2O$, in minor amounts, e.g., 0–5%, in oil shale, nahcolite ore or dawsonite ore, or in major amounts in trona ore, up to about 98%, typically 50–95%. The ore processable by this invention may include other naturally occurring sodium minerals such as: halite, NaCl; salt cake or sodium sulfate, $Na_2SO_4$; sodium sulfite, $Na_2SO_3$; sodium bisulfate, $NaHSO_4$: sodium bisulfite, $NaHSO_3$; wegscheiderite, $Na_2CO_3 \cdot 3NaHCO_3$; eitelite, $Na_2CO_3 \cdot MgCO_3$; shortite, $Na_2CO_3 \cdot 2CaCO_3$; pirssonite, $Na_2CO_3 \cdot CaCO_3 \cdot 2H_2O$; gaylussite, $Na_2CO_3 \cdot CaCO_3 \cdot 5H_2O$; burbankite, $Na_2Ca_4(CO_3)_5$; northupite, $Na_2Mg(CO_3)_2 \cdot NaCl$; bradleyite, $Na_2MgCO_3PO_4$; and tychite, na6$Mg_2(CO_3)_4(SO_4)$. These, plus nahcolite, trona and dawsonite are termed authigenic sodium minerals herein.

Typical higher grade nahcolite ore may range in assay as follows:

| Components | | Assay (weight percent) | | |
|---|---|---|---|---|
| A. Cold Water Solubles | | | | |
| 1) $NaHCO_3$ | | 75.0 | – | 85.3 |
| 2) $Cl^-$ | | 0.0033 | – | 0.0560 |
| | Subtotal | 75.0 | – | 85.36 |
| B. Cold Water Insolubles | | | | |
| 1) Dolomite - $CaMg(CO_3)_2$ | | 7.45 | – | 4.73 |
| 2) Dawsonite - $NaAlCO_3(OH)_2$ | | 2.65 | – | 1.65 |
| 3) Silica - $SiO_2$ | | 2.56 | – | 0.59 |
| 4) Iron - Fe | | 0.45 | – | 0.38 |
| 5) Sulfur (Organic + $FeS_2$) | | 0.52 | – | 0.45 |
| 6) K - Feldspar and Calcite ($K_xAl_ySi_zO_w$ and $CaCO_3$) | | 8.98 | – | 5.87 |
| 7) Total Organics (Organic Carbon Alone) | | 2.37 (1.91) | – | 1.03 (0.83) |
| | Subtotal | 25.0 | – | 14.7 |
| | Total | 100 | – | 100 |

The head ore may be liberated by crushing and grinding and preconcentrated or beneficiated by screening prior to flotation. The head ore head particle size may be varied widely, depending on the type and grade of ore, and on the liberation characteristics of the authigenic sodium mineralization. For example, a substantial portion of the feed may be −6 mesh, typically −28 mesh, and preferably −65 mesh for best recovery of nahcolite, dawsonite, trona or other authigenic sodium mineralization.

DETAILED DESCRIPTION OF SPECIFIC EXAMPLES

The following specific examples are by way of illustration and not limitation of the general principles of this invention.

Samples of different raw ores were used in the tests below which assayed as follows:

| | $NaHCO_3$ weight % | $Na_2CO_3$ weight % | Oil gal/ton |
|---|---|---|---|
| Sample 1 | 56.9 | 1.50 | 14.2 |
| Sample 2 | 45.5 | 1.00 | 10.6 |
| Sample 3 | 51.6 | 1.29 | 9.36 |

Mineralogical composition of the samples determined by semi-quantitative x-ray diffraction was as follows (approximate weight percentages):

| | Nahcolite % | Dolomite % | Analcime % | Quartz % | Feldspar % |
|---|---|---|---|---|---|
| Sample 1 | 45 | 25 | 15 | 10 | 5 |
| Sample 2 | 35 | 25 | 20 | 15 | 5 |
| Sample 3 | 40 | 20 | 30 | 10 | — |

By emission spectrography all three samples were also found to contain small quantities (estimated .001–5%) of barium, copper, iron, lead, manganese, molybdenum, nickel, potassium, silver, strontium, titanium and vanadium in addition to the above compounds.

Thus, the raw ores tested below initially assayed from 45–57% $NaHCO_3$ (nahcolite content), 1.0–1.5% $Na_2CO_3$, and 9–14 gal/ton shale oil. By X-ray diffraction the approximate relative weight percent abundance of minerals in the raw ore was found to be:

| | |
|---|---|
| Nahcolite ($NaHCO_3$) | from 35 to 45%; |
| Dolomite ($CaMg(CO_3)_2$) | from 15 to 30%; |
| Analcime ($Na(AlSi_2O_6)H_20$) | from 20 to 25%; |
| Quartz ($SiO_2$) | from 10 to 15%; |
| Feldspars, K, Na, Ca Aluminum Silicates | from 0 to 5%. |

This ore was taken as representative of a typical marginal ore suitable for multi-mineral processing, having a medium grade of nahcolite ore with a relatively low amount of oil shale therein. This represents a relatively difficult case as there is a low amount of natural hydrocarbons for collection function in the ore, and the substantial beneficiation of both the oil shale and the nahcolite by the process of the invention best illustrates the unexpected and improved results of using our process.

A preliminary concentration of the nahcolite is produced by a size reduction and a screening. In the raw ore, the nahcolite is more brittle and amenable to crushing and grinding than most of the remaining rock constituents, and it is reduced more than the others in a hammer mill or the like. Screening the ground particles produces fines of a higher nahcolite concentration than the original ore. The oversize may be directly retorted for its shale oil values, or recycled in the grinding circuit to liberate more authigenic sodium mineralization values.

Size reduction, prior to the flotation beneficiation of this process is to liberate the mineral and oil shale values from each other in the ore. In this case, the samples were crushed, in a hammer mill, to 100%–28 mesh (Tyler Screen). By screening of the crushed material assaying 56.9% $NaHCO_3$ the following upgrading beneficiation results were produced:

| Screen Size (Tyler Mesh) | Weight % | Chemical Analysis wt % $NaHCO_3$ | Percent Distribution (% Recovery) wt % $NaHCO_3$ |
|---|---|---|---|
| Head Ore: | | | |
| Assay | 100 | 56.9 | 100 |
| Calculated for Sample | 100 | 57.4 | 100 |
| Product: | | | |
| −28 +65 mesh | 19.2 | 25.1 | 8.4 |
| −65 mesh | 80.8 | 65.1 | 91.6 |

The screening need not be limited to 65 mesh, but may be larger or smaller, generally in the range of from about 6 to 325 mesh. For example, screening a sample of the above ore at 100 mesh produced the following beneficiation:

| Screen Size (Tyler Mesh) | Weight % | Chemical Analysis wt % $NaHCO_3$ | Percent Distribution (% Recovery) wt % $NaHCO_3$ |
|---|---|---|---|
| Head Ore: | | | |
| Assay | 100 | 56.9 | 100 |
| Calculated for Sample | 100 | 57.4 | 100 |
| Product: | | | |
| +100 mesh | 27.6 | 30.1 | 14.5 |
| −100 mesh | 72.6 | 67.8 | 85.5 |

Thus, from an initial ore assaying about 57 weight % $NaHCO_3$ nahcolite values, the head feed can be upgraded by screeing by about 10% 20%, to between 65–68 weight % $NaHCO_3$, with retention of 86–92% of the total original nahcolite values.

Screening another sample produced the following beneficiation results:

| Screen Size (Tyler Mesh) | Weight % | Chemical Analysis wt % $NaHCO_3$ | Percent Distribution (% Recovery) wt % $NaHCO_3$ |
|---|---|---|---|
| Head Ore: | | | |
| Assay | 100 | 51.6 | 100 |
| Calculated for Sample | 100 | 50.5 | 100 |
| Product: | | | |
| −28 +65 mesh | 15.1 | 20.0 | 5.9 |

-continued

| Screen Size (Tyler Mesh) | Weight % | Chemical Analysis wt % $NaHCO_3$ | Percent Distribution (% Recovery) wt % $NaHCO_3$ |
|---|---|---|---|
| −65 mesh | 84.9 | 55.9 | 94.1 |

This sample, screened further at 100, 150 and 200 mesh produced fines products (−100m, −150m and −200m) having about 59, 60.7, and 63 weight % $NaHCO_3$, respectively. Distribution percentages (% recoveries) were about 90.5, 86, and 77.5%, respectively.

Similarly, initially higher grade (with respect to nahcolite, dawsonite, or trona) ore can be upgraded prior to flotation. Correspondingly, the shale oil assay in the oversize may be increased to within the commercially acceptable range of above about 20 G.P.T.

While not required, we therefore prefer to pre-concentrate (beneficiate) the ore by grinding and screening prior to flotation. For conciseness, upgrading of the sodium values, principally sodium bicarbonate and sodium carbonate (nahcolite, trona, and soda ash) will be referred to and illustrated hereinafter, but it should be understood that similar upgrading of the oil shale values also occurs by selection of the appropriate fraction.

We have discovered that the kerogen in the ore is soft, and during the size reduction with certain types of size reduction equipment, it generally "smears" over the associated inorganic materials. While we do not wish to be bound by theory, we believe the smearing tends to prevent a clean separation of the organic and inorganic materials of the ore during flotation. It was found, however, that the use of a hammer mill or similar for the size reduction tends to reduce the attendent smearing, and such equipment is one type of size reduction equipment of choice.

In the following examples, laboratory tests were conducted on the crushed, ground and screened ore, by pulping the above undersize samples with various aqueous sodium carbonate and/or bicarbonate-containing brines in which the soluble ingredients of the ore are in equilibrium with soluble ingredients in the liquid and in the gas phase, for the said flotation system of this invention. A Fagergren flotation machine was used for this investigation, and the tables indicate brine pH, composition, frothers and froth control agents, if any, added collection agents, if any, and type of system (single or multiple-stage flotation).

As noted in more detail below, the brines may be preprepared by dissolving $NaHCO_3$ and/or $Na_2CO_3$ in water, or one may use a natural ore-derived brine prepared from water and ore head feed. The soluble constituents of the ore dissolve in the water until equilibrium is reached under the froth flotation system conditions of temperature, relative humidity, type and grade of ore, percent solids, and aeration gas. In the alternative to air as the aeration medium, other gases may be used, for example, an inert gas such as nitrogen, or carbon dioxide, or $O_2$, CO or $CO_2$-enriched air or inert gas.

Because of limited availability of consistent grades of ore necessary to produce natural, ore-derived brine, pre-prepared brines were used for the controlled testing investigations herein. The test results below are corrected for brine contribution. For example, the wet weight of the underflow is taken and compared to the dry. From the known brine composition, the contribution to total product by the brine can be simply calculated, and subtracted to give true yields and flotation efficiency. Contribution by the brine may add from 1–2% to the product weight. Under steady state froth flotation system conditions, this may be ignored since any loss from the brine to underflow or float product is made up by dissolution from the head feed ore.

BRINE PREPARATION

A 100-g charge of each of the above-described ore samples 1, 2 and 3 was leached with 100 ml of deionized water in a closed vessel at 70°F for 3 hr. For the entire period the pulp was mixed by a magnetic stirrer. After 3 hr of leaching the resulting leach solution was filtered from the remaining solids and assayed. The brines thus derived from natural raw oil shale/authigenic sodium mineral-containing ores have the following chemical compositions:

| Brine | Chemical Analysis Na gpl | Ca gpl | Mg gpl | Fe gpl | Al gpl | $CO_3$ gpl | $HCO_3$ gpl | Cl gpl | $SO_4$ gpl |
|---|---|---|---|---|---|---|---|---|---|
| Sample 1 | 36.0 | 0.01 | 0.01 | 0.11 | <0.01 | 2.13 | 118.0 | 0.64 | 3.86 |
| Sample 2 | 32.0 | 0.01 | 0.02 | 0.09 | <0.01 | 2.55 | 102.5 | 0.10 | 4.11 |
| Sample 3 | 34.6 | 0.01 | 0.01 | 0.24 | <0.01 | 1.70 | 106.5 | 0.17 | 2.38 |

Pre-prepared test brine "A" was prepared on the basis of the above chemical composition of the three ore-derived brines. The maximum amounts of major anionic components ($CO_3^{=}$, $HCO_3^{-}$, $Cl^{-}$, $SO_4^{=}$,) as found in the natural ore-derived brines were added to deionized water. These amounts were: 2.55 gpl $CO_3^{--}$, 118.0 gpl $HCO_3^{-}$, 0.64 gpl $Cl^{-}$, and 4.11 gpl $SO_4^{--}$. The amounts of salts used to prepare the former were: 162.5 gpl $NaHCO_3$, 5.28 gpl $NaCO_3 \cdot H_2O$, 1.06 gpl NaCL, and 12.25 gpl $Na_2SO_4 \cdot 10H_2O$. The resulting pre-prepared brine "A", was used for Group II Flotation Tests 1 through 12 described below.

Pre-prepared test brine "B" was prepared by partially saturating deionized water with NaCl (1.06 gpl) and $Na_2SO_4 \cdot 10H_2O$ (12.25 gpl), and fully saturating it with $Na_2CO_3$ (225 gpl at 70°F) first. The solution was then agitated for 1 hr. Subsequently $NaHCO_3$ (176 gpl) was added to the solution which was again mixed for 1 hr. The resulting pre-prepared brine "B" had the following composition with regard to sodium carbonate and bicarbonate:

| $CO_3^{--}$ gpl | $HCO_3^{-}$ gpl | $Na_2CO_3$ gpl | $NaHCO_3$ gpl |
|---|---|---|---|
| 113.45 | 10.97 | 200.4 | 15.1 |

Some amounts of both $Na_2CO_3$ and $NaHCO_3$ remained undissolved in the brine indicating its saturation. This brine was used in Group II Flotation Tests 13 through 15 described below:

BRINE "A"

| Brine Sample No. | Brine Preparation and/or Treatment | pH | Environment Temperature °F |
|---|---|---|---|
| 1 | Brine prepared in a closed vessel, without being exposed to air, 1 hr after preparation. | 8.22 | 70 |
| 2 | Brine prepared in an open vessel, 70 hr after preparation. Used for Flotation Tests 1–12. | 8.81 | 70 |
| 3 | Brine prepared in an open vessel, 70 hr after preparation, aerated for 6 min. | 8.91 | 70 |
| 4 | Brine prepared in an open vessel, used in a flotation test from which it was obtained as filtrate. | 8.86 | 70 |
| 5 | Brine prepared in an open vessel, 96 hr after preparation. | 8.77 | 70 |
| 6 | Brine prepared in an open vessel, used in flotation tests and wet screening, accumulated in filtrate trap. | 8.89 | 70 |

BRINE "B"

| Brine Sample No. | Brine Preparation and/or Treatment | pH | TDS gpl at 150°F | $HCO_3$ gpl | $CO_3$ gpl | Environment Temp. °F |
|---|---|---|---|---|---|---|
| 7 | Brine prepared in an open vessel, used for Flotation Tests 13–15 | 9.85 | 215.5 | 10.97 | 113.45 | 70 |
| 8 | Brine prepared in an open vessel, aerated for 6 min. | 9.87 | 215.2 | 11.5 | 109.65 | 70 |

Group I test brines were prepared similarly to Group II with the $NaHCO_3$ and $Na_2CO_3$ compositions reported below. The above and following tests show the brine pH may be stable or change within the above-described range during flotation.

| Test No. | Brine Composition $NaHCO_3$ g/l | $Na_2CO_3$ g/l |
|---|---|---|
| 16 | 80.3 | 35.6 |
| 17 | 81.5 | 32.0 |
| 18 | 81.4 | 31.2 |
| 19 | 72.7 | 40.9 |
| 21 | 80.1 | 46.3 |
| 22 | 84.5 | 45.1 |
| 23 | 116.8 | 52.4 |
| 24 | 116.8 | 52.4 |
| 25 | 116.8 | 52.4 |

ing, followed by rougher flotation for 2 minutes. The pulp was reconditioned for 1 minute with the balance of the frother, followed by a second 2 minute rougher flotation. The amounts of frother agent were added in accordance with the following schedule:

| Test No. | Frother | 1st Conditioning | 2nd Conditioning |
|---|---|---|---|
| 16 | MIBC | 2.3 lbs/ton | — |
| 17 | Pine Oil | 1.7 lbs/ton | 0.7 lbs/ton |

Parameters and results of the tests are tabulated below in Table I.

TABLE I

GROUP I-A TESTS
FLOTATION FEED ASSAY: 62.6% $NaHCO_3$; 0.0% $Na_2CO_3$; −28 mesh (Tyler Screen)

| FLOTATION TEST NO. | No. 16 | | | No. 17 | | |
|---|---|---|---|---|---|---|
| REAGENT: TYPE - Frother | | MIBC | | | PINE OIL | |
| lb/ton - Float Feed | | 2.3 | | | 2.4 | |
| % SOLIDS IN PULP | | 20% | | | 5% | |
| BRINE pH: Start - Finish | | 8.8 – 8.8 | | | 8.7 – 8.7 | |
| (1)HEAD (Calculated)[a] | | | | | | |
| (a) Wt.% | | 100.0% | | | 100.0% | |
| (b) Chemical Analysis[b] | | | | | | |
| %$Na_2O$ & $NaHCO_3$ | 7.7% | | 20.8% | 12.5% | | 33.9% |
| %$Na_2O$ & $Na_2CO_3$ | 17.9% | | 3.6% | 9.4% | | 16.1% |
| Total % $Na_2O$ | 25.6% | | | 21.9% | | |
| (2)FLOAT (TAILS) | | | | | | |
| (a) Wt.% | | 72.7% | | | 56.3% | |
| (b) Chemical Analysis[b] | | | | | | |
| %$Na_2O$ & $NaHCO_3$ | 0.2% | | 0.7% | 4.6% | | 12.4% |
| %$Na_2O$ & $Na_2CO_3$ | 14.1% | | 24.1% | 6.0% | | 10.3% |
| Total % $Na_2O$ | 14.3% | | | 10.6% | | |
| (c) % Distribution | | | | | | |
| $NaHCO_3$ | | | 2.3% | | | 20.6% |
| $Na_2CO_3$ | | | 53.5% | | | 64.0% |
| (d) % Distribution, $Na_2O$[c] | 40.6% | | | 27.0% | | |
| (3)NON-FLOAT (Concentrate) | | | | | | |
| (a) Wt.% | | 37.3% | | | 43.7% | |
| (b) Chemical Analysis[b] | | | | | | |
| %$Na_2O$ & $NaHCO_3$ | 20.1% | | 54.5% | 22.8% | | 61.7% |
| %$Na_2O$ & $Na_2CO_3$ | 20.6% | | 35.2% | 13.7% | | 23.5% |
| Total % $Na_2O$ | 40.7% | | | 36.5% | | |
| (c) % Distribution | | | | | | |
| $NaHCO_3$ | | 97.7% | | | 79.4% | |
| $Na_2CO_3$ | | 46.5% | | | 36.0% | |
| (d) % Distribution, $Na_2O$[c] | 59.4% | | | 73.0% | | |
| Chemical Analysis - $Na_2O$ | 40.7% | | | 36.5% | | |
| Chem.Anal.-$NaHCO_3$ Equiv. | 110.3% | | | 98.9% | | |
| (4)BRINE COMPOSITION | | | | | | |
| $NaHCO_3$ g/l | | 80.3g/l | | | 81.5g/l | |
| $Na_2CO_3$ g/l | | 35.6g/l | | | 32.0g/l | |
| (5)METHOD-FLOTATION | Conditioned, 2 min Rougher Float, 8 min | | | Conditioned, 1 min 1st Rougher Float, 2 min Reconditioned, 1 min 2nd Rougher Float, 2 min | | |

[a]Cross check with flotation feed assay.
[b]Corrected for brine, but not for conversion of $NaHCO_3$ to $Na_2CO_3$ during drying.
[c]Corrected for brine and for drying.

SPECIFIC EXAMPLES

Group IA Tests.

Frothers. Two tests using frothers with a mixed $NaHCO_3/Na_2CO_3$ brine of a pH about 8.75 were run as follows: A −28 mesh feed assaying 62.6% nahcolite $NaHCO_3$ was pulped in a pre-prepared brine. For Test No. 16, all the MIBC frother was added during an initial 2 minutes conditioning step, followed by a rougher flotation of 8 minutes duration. For Test No. 17, some pine oil frother was added before 1 minute condition-

Froth Control Agents.

A series of tests using various froth control agents with a mixed $NaHCO_3/Na_2CO_3$ brine of pH about 8.75 were run as follows: A −28 mesh feed assaying 62.6 nahcolite $NaHCO_3$ in the pre-prepared brine. For tests 18, 21 and 22, the pulp was conditioned for 1 minute with a portion of the froth control agent, followed by rougher flotation for 2 minutes. The pulp was then reconditioned for 1 minute with addition of the balance of the froth control agent, followed by a second 2-minute rougher flotation. The amounts of froth control agent were added in accordance with the following schedule:

| Test No. | Froth Control Agent | 1st Conditioning | 2nd Conditioning |
|---|---|---|---|
| 18 | 1-Hexanol | .9 lbs/ton | .4 lbs/ton |
| 21 | 1-Hexanol | 3.1 lbs/ton | 1.2 lbs/ton |

-continued

| Test No. | Froth Control Agent | 1st Conditioning | 2nd Conditioning |
|---|---|---|---|
| 22 | 1-Octanol | 3.1 lbs/ton | 1.2 lbs/ton |

Parameters and results of the tests are tabulated below in Table II.

The $Na_2O$ percent distribution values under 3(d) show the total sodium recovery, predominantly $NaHCO_3$(-

TABLE II

GROUP I-A TESTS
FLOTATION FEED ASSAY: 62.6% $NaHCO_3$; 0.0% $Na_2CO_3$; −28 mesh (Tyler Screen)

| FLOTATION TEST NO. | No. 18 | | No. 21 | |
|---|---|---|---|---|
| REAGENT: TYPE-Froth Control Agent | 1-HEXANOL | | 1-HEXANOL | |
| lb/ton - Float Feed | 1.3 | | 4.3 | |
| % SOLIDS IN PULP | 2.5% | | 20% | |
| BRINE pH: Start - Finish | 8.7 – 8.7 | | 8.8 – 8.8 | |
| (1)HEAD (Calculated)[a] | | | | |
| (a) Wt.% | 100.0% | | 100.0% | |
| (b) Chemical Analysis[Analysis] | | | | |
| %$Na_2O$ & $NaHCO_3$ | 16.1% | 43.7% | 10.6% | 28.8% |
| % $Na_2$& $Na_2CO_3$ | 6.0% | 10.3% | 13.9% | 23.7% |
| Total & $Na_2O$ | 22.1% | | 24.5% | |
| (2)FLOAT (TAILS) | | | | |
| (a) Wt.% | 47.4% | | 43.2% | |
| (b) Chemical Analysis[b] | | | | |
| %$Na_2O$ & $NaHCO_3$ | 2.2% | 5.9% | 0.0% | 0.0% |
| %$Na_2O$ & $Na_2CO_3$ | 1.2% | 2.1% | 12.5% | 21.4% |
| Total % $Na_2O$ | 3.4% | | 12.5% | |
| (c) % Distribution | | | | |
| $NaHCO_3$ | | 6.4% | | 0.0% |
| $Na_2CO_3$ | | 9.8% | 39.0% | |
| (d) % Distribution, $Na_2O$[c] | 6.8% | | 22.3% | |
| (3)NON-FLOAT (Concentrate) | | | | |
| (a) Wt.% | 52.6% | | 56.8% | |
| (b) Chemical Analysis[b] | | | | |
| %$Na_2O$ & $NaHCO_3$ | 28.7% | 77.9% | 18.7% | 50.8% |
| %$Na_2O$ & $Na_2CO_3$ | 10.4% | 17.7% | 14.8% | 25.3% |
| Total % $Na_2O$ | 39.1% | | 33.5% | |
| (c) % Distribution | | | | |
| $NaHCO_3$ | 93.6% | | 100.0% | |
| $Na_2CO_3$ | 92.2% | | 61.0% | |
| (d) % Distribution, $Na_2O$[c] | 93.2% | | 77.7% | |
| Chemical Analysis - $Na_2O$ | 39.1% | | 33.5% | |
| Chem.Anal.-$NaHCO_3$ Equiv. | 106.0% | | 90.8% | |
| (4)BRINE COMPOSITION | | | | |
| $NaHCO_3$ g/l | 81.4g/l | | 80.1g/l | |
| $Na_2CO_3$ g/l | 31.2g/l | | 46.3g/l | |
| (5)METHOD-FLOTATION | Same as No. 17 | | Same as No. 17 | |

| FLOTATION TEST NO. | No. 22 | | |
|---|---|---|---|
| REAGENT: TYPE-Froth Control Agent | 1-OCTANOL | | |
| lb/ton - Float Feed | 4.3 | | |
| % SOLIDS IN PULP | 20% | | |
| BRINE pH: Start - Finish | 8.8 – 8.8 | | |
| (1)HEAD (Calculated)[a] | | | |
| (a) Wt.% | 100.0% | | |
| (b) Chemical Analysis[b] | | | |
| %$Na_2O$ & $NaHCO_3$ | 3.3% | 8.9% | |
| %$Na_2O$ & $Na_2CO_3$ | 23.2% | | 39.7% |
| Total % $Na_2O$ | 26.5% | | |
| (2)FLOAT (TAILS) | | | |
| (a) Wt.% | 29.8% | | |
| (b) Chemical Analysis[b] | | | |
| %$Na_2O$ & $NaHCO_3$ | 0.0% | | 0.0% |
| %$Na_2O$ & $Na_2CO_3$ | 15.3% | | 26.2% |
| Total % $Na_2O$ | 15.3% | | |
| (c) % Distribution | | | |
| $NaHCO_3$ | | | 0.0% |
| $Na_2CO_3$ | | | 19.7% |
| (d) % Distribution, $Na_2O$[c] | 17.1% | | |
| (3) NON-FLOAT (Concentrate) | | | |
| (a) Wt.% | 70.2% | | |
| (b) Chemical Analysis[b] | | | |
| %$Na_2O$ & $NaHCO_3$ | 4.7% | | 12.7% |
| %$Na_2O$ & $Na_2CO_3$ | 26.6% | | 45.5% |
| Total % $Na_2O$ | 31.3% | | |
| (c) % Distribution | | | |
| $NaHCO_3$ | 100.0% | | |
| $Na_2CO_3$ | 80.3% | | |
| (d) % Distribution, $Na_2O$[c] | 82.9% | | |
| Chemical Analysis - $Na_2O$ | 31.3% | | |
| Chem.Anal.-$NaHCO_3$ Equiv. | 84.8% | | |
| (4)BRINE COMPOSITION | | | |
| $NaHCO_3$ g/l | 84.5g/l | | |
| $Na_2CO_3$ g/l | 45.1g/l | | |
| (5)METHOD-FLOTATION | Same as No. 17 | | |

[a]Cross check with flotation feed assay.
[b]Corrected for brine, but not for conversion of $NaHCO_3$ to $Na_2CO_3$ during drying.
[c]Corrected for brine and for drying.

nahcolite) and $Na_2CO_3$, together expressed as $Na_2O$, in the non-float portion. The recoveries range from 59.4 to 73.0% with frother agents, and 77.7% to 93.2% for froth controlling agents. Conversely, the float portion shows low sodium recovery 6.8 – 40.6% for both types of agents, which indicates the oil shale, less the sodium carbonate and sodium bicarbonate mineralization, is concentrated and upgraded in that fraction.

Group I-B Tests.

This series used the same assay and size feed as in Group I-A tests, but the pre-prepared brine mixture ranged from 72.0 – 72.7 g/l $NaHCO_3$ and 37.5 – 40.9 g/l $Na_2CO_3$. For Test No. 15 the flotation employed the following flow sheet with pine oil being used as a frother agent:

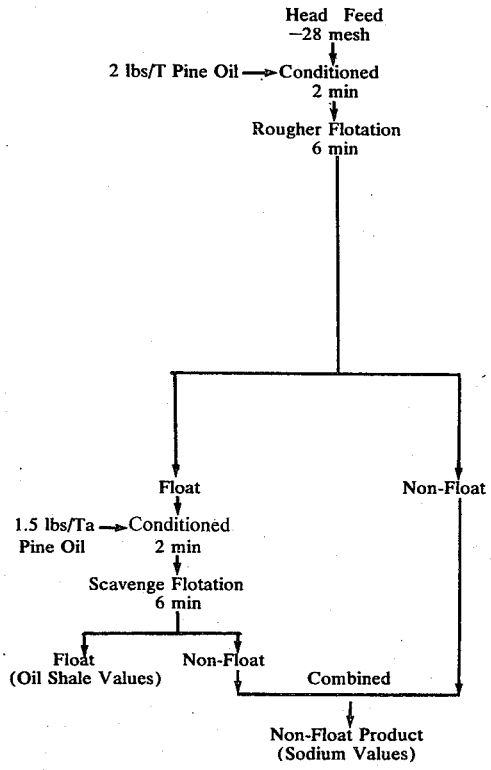

Test No. 19 employed a combination of a collection agent and a frother agent, Kerosine and Aerofroth 73. The total amounts listed for both were added to the pulp and conditioning was for 1 minutes, followed by a 5-minute rougher float.

Test No. 20 employed two frother agents, cresylic acid and Aerofroth 73 at different stages of the flotation procedure. While we do not wish to be bounded by theory, we believe the cresylic acid may also function in a dual manner, in part as a collection agent, particularly for sulfides, as well as a frother. The procedure was:

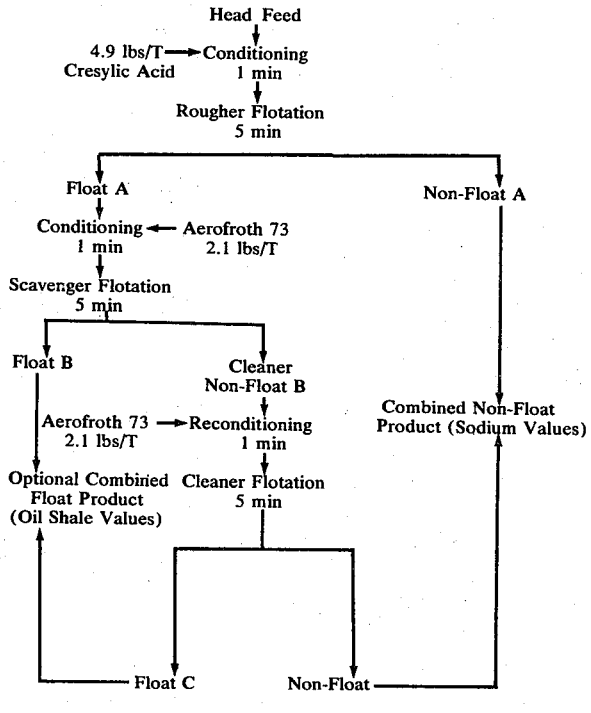

Detailed parameters and results of Tests 15, 19 and 20 are presented in Table III below. The pH values were similar to those of Test Group I-A, but the solids percentages in the pulp varied.

TABLE III

GROUP I-B TESTS
FLOTATION FEED ASSAY: 62.6% $NaHCO_3$; 0.0% $Na_2CO_3$; −28 mesh (Tyler Screen)

| FLOTATION TEST NO. | No. 15 | | No. 19 | | |
|---|---|---|---|---|---|
| REAGENT: TYPE: | PINE OIL (frother) | | KEROSINE (collector) | AEROFROTH 73 (frother) | |
| Lb/Ton-Float Feed | 3.5 | | 0.6 | 0.5 | |
| % SOLIDS IN PULP | 20% | | | 20% | |
| BRINE pH: Start — Finish | 8.8 — 8.8 | | | 8.7 — 8.7 | |
| (1)HEAD (Calculated)[a] | | | | | |
| (a) Wt.% | 100.0% | | | 100.0% | |
| (b) Chemical Analysis[b] | | | | | |
| %$Na_2O$ & $NaHCO_3$ | 13.0% | 35.3% | 11.1% | | 30.3% |
| %$Na_2O$ & $Na_2CO_3$ | 8.4% | 14.3% | 10.6% | | 18.2% |
| Total % $Na_2O$ | 21.4% | | 21.7% | | |
| (2)FLOAT (TAILS) | | | | | |
| (a) Wt.% | 44.4% | | | 61.3% | |
| (b) Chemical Analysis[b] | | | | | |
| %$Na_2O$ & $NaHCO_3$ | 3.0% | 8.0% | 3.9% | | 10.7% |
| $Na_2O$ & $Na_2CO_3$ | 4.4% | 7.5% | 7.0% | | 12.0% |
| Total % $Na_2O$ | 7.4% | | 10.9% | | |

TABLE III-continued

GROUP I-B TESTS
FLOTATION FEED ASSAY: 62.6% $NaHCO_3$; 0.0% $Na_2CO_3$; −28 mesh (Tyler Screen)

| | | | | | |
|---|---|---|---|---|---|
| (c) % Distribution | | | | | |
| $NaHCO_3$ | | 10.0% | | | 21.6% |
| $Na_2CO_3$ | | 23.3% | | | 28.7% |
| (d) % Distribution $Na_2O$[c] | 15.5% | | 30.4% | | |
| (3)NON-FLOAT (Concentrate) | | | | | |
| (a) Wt.% | | 55.6% | | 38.7% | |
| (b) Chemical Analysis[b] | | | | | |
| %$Na_2O$ & $NaHCO_3$ | 21.2% | 57.2% | 22.7% | | 61.5% |
| %$Na_2O$ & $Na_2CO_3$ | 11.5% | 19.7% | 16.3% | | 27.9% |
| Total % $Na_2O$ | 32.6% | | 39.0% | | |
| (c) % Distribution | | | | | |
| $NaHCO_3$ | | 90.0% | | 78.4% | |
| $Na_2CO_3$ | | 76.7% | | 71.3% | |
| (d) % Distribution $Na_2O$[c] | 84.5% | | 69.6% | | |
| Chemical Analysis — $Na_2O$ | 32.6% | | 39.0% | | |
| Chem.Anal.-$NaHCO_3$Equiv. | 88.3% | | 105.7% | | |
| (4) BRINE COMPOSITION | | | | | |
| $NaHCO_3$ g/l | | 72.0g/l | | 72.7g/l | |
| $Na_2CO_3$ g/l | | 37.5g/l | | 40.9g/l | |
| (5) METHOD-FLOTATION | Conditioning 2 min<br>Rougher Float 6 min<br>Recondition Float 2 min<br>Scavenge Float 6 min<br>Combine Non-Float | | Conditioning 1 min<br>Rougher Float 5 min | | |

[a]Cross check with flotation feed assay
[b]Corrected for brine, but not for conversion of $NaHCO_3$ to $Na_2CO_3$ during drying.
[c]Corrected for brine and for drying.

| FLOTATION TEST NO. | No. 20 | | |
|---|---|---|---|
| REAGENT: TYPE: | CRESYLIC ACID (frother & collector) | — | AEROFROTH 73 (frother) |
| Lb/Ton-Float Feed | 4.9 | | 4.2 |
| %SOLIDS IN PULP | | 10% | |
| BRINE pH: Start — Finish | | 8.7 — 8.7 | |
| (1)HEAD (Calculated)[a] | | | |
| (a) Wt.% | | 100.0% | |
| (b) Chemical Analysis[b] | | | |
| %$Na_2O$ & $NaHCO_3$ | 13.5% | | 36.6% |
| %$Na_2O$ & $Na_2CO_3$ | 6.8% | | 11.7% |
| Total % $Na_2O$ | 20.3% | | |
| (2) FLOAT (TAILS) | | | |
| (a) Wt.% | | 61.2% | |
| (b) Chemical Analysis[b] | | | |
| %$Na_2O$ & $NaHCO_3$ | 5.5% | | 15.0% |
| %$Na_2O$ & $Na_2CO_3$ | 4.5% | | 7.7% |
| Total % $Na_2O$ | 10.0% | | |
| (c) % Distribution | | | |
| $NaHCO_3$ | | | 25.1% |
| $Na_2CO_3$ | | | 40.2% |
| (d) % Distribution $Na_2O$[c] | 30.0% | | |
| (3)NON-FLOAT (Concentrate) | | | |
| (a) Wt.% | | 38.8% | |
| (b) Chemical Analysis[b] | | | |
| %$Na_2O$ & $NaHCO_3$ | 26.0% | | 70.6% |
| %$Na_2O$ & $Na_2CO_3$ | 10.5% | | 18.0% |
| Total % $Na_2O$ | 36.5% | | |
| (c) % Distribution | | | |
| $NaHCO_3$ | | 74.9% | |
| $Na_2CO_3$ | | 59.8% | |
| (d) % Distribution $Na_2O$[c] | 70.0% | | |
| Chemical Analysis — $Na_2O$ | 36.5% | | |
| Chem. Anal.-$NaHCO_3$Equiv. | 98.9% | | |
| (4) BRINE COMPOSITION | | | |
| $NaHCO_3$ g/l | * | | |
| $Na_2CO_3$ g/l | * | — | |
| (5) METHOD-FLOTATION | Conditioning 1 min<br>Rougher Flotation 5 min<br>Recondition Float 1 min<br>Scavenger Flotation 5 min<br>Recondition Cleaner Non-Float 1 min<br>Cleaner Flotation 5 min<br>Combine Non-Float Products<br>Optional, Combine Float Products | | |

* Assay not recorded, essentially the same as Test No. 19 brine from pH value relationship.

Group I-C Tests.

In this group of tests, the froth control agent was the same; the brine pH and composition, and the % solids in the pulp were maintained the same. The feed type and amount of froth control agent were varied to show upgrading and recovery of oil shale values in the float product. In all tests there was a conditioning for 1 minute with a portion of the 1-hexanol, followed by a 2-minute rougher float, reconditioning for 1 minute with the balance of the 1-hexanol, followed by a second 2-minute rougher float to produce the float and non-float products. The froth control agents were added according to the following schedule (amounts in lbs/ton float feed (head)):

| Test No. | Froth Control Agent | 1st Conditioning | 2nd Conditioning |
|---|---|---|---|
| 23 | 1-hexanol | 3.1 | 1.2 |
| 24 | 1-hexanol | 3.1 | 2.1 |
| 25 | 1-hexanol | 3.1 | 3.1 |

The brine was a more saturated brine than in Groups I-A and B. Parameters and results are seen in Table IV:

10

TABLE IV

GROUP I-C TESTS
FLOTATION FEED: Assay below; −28 mesh (Tyler Screen)

| FLOTATION TEST NO. | No. 23 | | | No. 24 | | |
|---|---|---|---|---|---|---|
| REAGENT: TYPE-Froth Control Agents | | 1-Hexanol | | | 1-Hexanol | |
| Lb/Ton Float Feed | | 4.3 | | | 5.2 | |
| % SOLIDS IN PULP | | 25% | | | 25% | |
| BRINE pH: Start — Finish | | 8.8 — 8.8 | | | 8.8 — 8.8 | |
| (1)HEAD | | | | | | |
| (a) Feed Assay | | | | | | |
| % $NaHCO_3$ | | 59.5% | | | 53.7% | |
| % $Na_2CO_3$ | | 1.2% | | | 2.7% | |
| (b) Wt.% (calculated)[a] | | 100.0% | | | 100.0% | |
| (c) Chemical Analysis (calc.)[b] | | | | | | |
| % $Na_2O$ & $NaHCO_3$ | 20.8% | 56.4% | | 19.4% | 52.6% | |
| % $Na_2O$ & $Na_2CO_3$ | 2.4% | 4.1% | | 2.5% | 4.3% | |
| Shale Oil — Gal/Ton | | | 7.6G.P.T. | | | 13.6G.P.T. |
| Total $Na_2O$ & G.P.T. | 23.2% | | 7.6G.P.T. | 21.9% | | 13.6G.P.T. |
| (2)FLOAT(TAILS) | | | | | | |
| (a) Wt.% | | 37.8% | | | 33.6% | |
| (b) Chemical Analysis[6] | | | | | | |
| %$Na_2O$ & $NaHCO_3$ | 10.1% | 27.4% | | 7.3% | 19.8% | |
| %$Na_2O$ & $Na_2CO_3$ | 1.3% | 2.2% | | 1.6% | 2.8% | |
| Shale Oil — Gal/Ton | | | 15.9G.P.T. | | 26.8G.P.T. | |
| Total $Na_2O$ & G.P.T. | 11.4% | | 15.9G.P.T. | 8.9% | | 26.8G.P.T. |
| (c) % Distribution | | | | | | |
| $NaHCO_3$ | | 18.4% | | | 12.6% | |
| $Na_2CO_3$ | | 20.8% | | | 22.1% | |
| Shale Oil | | | 78.8% | | 66.3% | |
| (d) % Distribution, $Na_2O$[c] | | 18.8% | | | 13.7% | |
| (3)NON-FLOAT (Concentrate) | | | | | | |
| (a) Wt.% | | 62.2% | | | 66.4% | |
| (b) Chemical Analysis[b] | | | | | | |
| %$Na_2O$ & $NaHCO_3$ | 27.3% | 74.1% | | 25.6% | 69.3% | |
| %$Na_2O$ & $Na_2CO_3$ | 3.0% | 5.1% | | 2.9% | 5.0% | |
| Shale Oil — Gal/Ton | | | 2.6G.P.T. | | | 6.9G.P.T. |
| Total $Na_2O$ & G.P.T. | 30.3% | | 2.6G.P.T. | 28.5% | | 6.9G.P.T. |
| (c) % Distribution | | | | | | |
| $NaHCO_3$ | | 81.6% | | | 87.4% | |
| $Na_2CO_3$ | | 79.2% | | | 77.9% | |
| Shale Oil | | | 21.2% | | | 33.7% |
| (d) % Distribution $Na_2O$[c] | 81.2% | | | 86.3% | | |
| Chemical Analysis — $Na_2O$ | 30.3% | | | 28.5% | | |
| Chem.Anal.-$NaHCO_3$Equiv. | 82.1% | | | 77.2% | | |
| (4)BRINE COMPOSITION | | | | | | |
| $NaHCO_3$ g/l | | 116.8g/l | | | 116.8g/l | |
| $Na_2CO_3$ g/l | | 52.4g/l | | | 52.4g/l | |
| (5)METHOD-FLOTATION | Condition 1 min<br>Rougher Float 2 min<br>Recondition 1 min<br>2nd Rougher Float<br>Recover Products | | | | Same as 23 | |

[a]Cross check with flotation feed assay
[b]Corrected for brine, but not for conversion of $NaHCO_3$ to $Na_2CO_3$ during drying
[c]Corrected for brine and for drying

| FLOTATION TEST NO. | No. 25 | | |
|---|---|---|---|
| REAGENT: TYPE-Froth Control Agents | | 1-Hexanol | |
| Lb/Ton Float Feed | | 6.2 | |
| % SOLIDS IN PULP | | 25% | |
| BRINE pH: Start — Finish | | 8.8 — 8.8 | |
| (1)HEAD | | | |
| (a) Feed Assay | | | |
| % $NaHCO_3$ | | 57.2% | |
| % $Na_2CO_3$ | | 3.7% | |
| (b) Wt.% (calculated)[a] | | 100.0% | |
| (c) Chemical Analysis (calc.)[b] | | | |
| % $Na_2O$ & $NaHCO_3$ | 20.2% | 54.9% | |
| % $Na_2O$ & $Na_2CO_3$ | 2.6% | 4.4% | |
| Shale Oil — Gal/Ton | | | 18.4 G.P.T. |
| Total $Na_2O$ & G.P.T. | 22.8% | | 18.4 G.P.T. |
| (2)FLOAT(TAILS) | | | |
| (a) Wt.% | | 25.3% | |
| (b) Chemical Analysis[b] | | | |
| %$Na_2O$ & $NaHCO_3$ | 4.8% | 13.1% | |
| %$Na_2O$ & $Na_2CO_3$ | 2.1% | 3.6% | |
| Shale Oil — Gal/Ton | | | 43.1 G.P.T. |
| Total $Na_2O$ & G.P.T. | 6.9% | | 43.1 G.P.T. |

TABLE IV-continued

| GROUP I-C TESTS<br>FLOTATION FEED: Assay below; −28 mesh (Tyler Screen) | | | |
|---|---|---|---|
| (c) % Distribution | | | |
| $NaHCO_3$ | | 6.0% | |
| $Na_2CO_3$ | | 20.9% | |
| Shale Oil | | | 59.2% |
| (d) % Distribution, $Na_2O^c$ | | 7.5% | |
| (3)NON-FLOAT (Concentrate) | | | |
| (a) Wt.% | | 74.7% | |
| (b) Chemical Analysis[b] | | | |
| %$Na_2O$ & $NaHCO_3$ | 25.5% | 69.1% | |
| %$Na_2O$ & $Na_2CO_3$ | 2.7 | 4.6% | |
| Shale Oil — Gal/Ton | | | 10.1 G.P.T. |
| Total $Na_2O$ & G.P.T. | 28.2% | | 10.1 G.P.T. |
| (c) % Distribution | | | |
| $NaHCO_3$ | | 94.0% | |
| $Na_2CO_3$ | | 79.1% | |
| Shale Oil | | | 40.8% |
| (d) % Distribution $Na_2O^c$ | 92.5% | | |
| Chemical Analysis — $Na_2O$ | 28.2% | | |
| Chem.Anal.-$NaHCO_3$Equiv. | 76.4% | | |
| | | (4)BRINE COMPOSITION | |
| $NaHCO_3$ g/l | | 116.8g/l | |
| $Na_2CO_3$ g/l | | 52.4g/l | |
| (5) METHOD-FLOTATION | | Same as No. 23 | |

Very significant upgrading of the oil assays occurs in these tests as a result of the process of this invention. Comparing the gallons of oil per ton in the initial head feed, as calculated, with the values in the float product, it can be seen that the oil assay more than doubles as a result of the flotation:

| Test No. | Oil Assay, gpt<br>Head (Calculated) | Float Product |
|---|---|---|
| 23 | 7.6 | 15.9 |
| 24 | 13.6 | 26.8 |
| 25 | 18.4 | 43.1 |

Correspondingly, the sodium minerals grade is low in the float product. Conversely, as the shale oil content in the feed increases, the total sodium and nahcolite recovery increases in the non-float product:

| Test No. | Nahcolite Assay, %<br>Head | Non-Float Product | Recovery<br>wt% Nahcolite | wt% Total $Na_2O$ |
|---|---|---|---|---|
| 23 | 59.5 | 74.1 | 81.6 | 81.2 |
| 24 | 53.7 | 69.3 | 87.4 | 86.3 |
| 25 | 57.2 | 69.1 | 94.0 | 92.5 |

This series of tests demonstrates the ability of the process of this invention to produce excellent separation of the hydrocarbon values from sodium values for a variety of ores, even medium or low grade ores as to one or more of those values while upgrading those values to the range of significant commercial interest.

Group II-A Tests.

This test group compares the natural frothing characteristics of a $NaHCO_3$-saturated equilibrium brine without frothers or froth control agents, as well as the same brine employing frothers or froth control agents, while the % solids in the pulp was maintained at 17%. In addition, the non-float concentrate was post-flotation screened to upgrade the final product. In all flotation tests the head was pulped, conditioned 3 minutes with the entire amount of frother of froth control agent, if any (none used in Test No. 1), followed by a single rougher float of 3 minutes duration. The detailed parameters and results of the tests are shown in Table V:

TABLE V

| GROUP II-A TESTS<br>FLOTATION FEED ASSAY: 56.9% $NaHCO_3$; 1.50% $Na_2CO_3$; 14.2Gal/Ton Shale Oil; −28 mesh (Tyler Screen) | | | | | | |
|---|---|---|---|---|---|---|
| BRINE: SATURATED $NaHCO_3$ | | | | | | |
| FLOTATION TEST NO. | | No. 1 | | | No. 2 | |
| REAGENT: TYPE | | NONE | | | Methanol (Frother) | |
| Lb/Ton-Float Feed | | None | | | 0.50 | |
| % SOLIDS | | 17% | | | 17% | |
| pH: Start — Finish | | 8.7 – 8.8 | | | 8.7 – 8.8 | |
| (1)HEAD (Calculated)[a] | | | | | | |
| (a) Wt.% | | 100.0% | | | 100.0% | |
| (b) Chemical Analysis[b] | | | | | | |
| % $Na_2O$ & $NaHCO_3$ | 9.9% | | 26.8% | 10.2% | | 27.8% |
| %$Na_2O$ & $Na_2CO_3$ | 13.9% | | 23.7% | 13.3% | | 22.8% |
| Total % $Na_2O$ | 23.8% | | | 23.5% | | |
| (2) FLOAT (Tails) | | | | | | |
| (a) Wt.% | | 43.5% | | | 38.0% | |
| (b) Chemical Analysis[b] | | | | | | |
| % $Na_2O$ & $NaHCO_3$ | 11.2% | | 30.3% | 1.0% | | 2.71% |
| % $Na_2O$ & $Na_2CO_3$ | 1.5% | | 2.56% | 12.6% | | 21.8% |
| Total % $Na_2O$ | 12.7% | | | 13.6% | | |

TABLE V-continued

GROUP II-A TESTS
FLOTATION FEED ASSAY: 56.9% $NaHCO_3$; 1.50% $Na_2CO_3$; 14.2Gal/Ton Shale Oil; −28 mesh (Tyler Screen)

| | | | | | |
|---|---|---|---|---|---|
| (c) Distribution, % | | | | | |
| $NaHCO_3$ | | 49.2% | | 3.7% | |
| $Na_2CO_3$ | | 4.7% | | 36.4% | |
| (d) % Distribution $Na_2O$[c] | | 23.3% | | 22.0 | |
| (3)NON-FLOAT (Concentrate) | | | | | |
| (a) Wt.% +48 mesh | | 15.5% | | 16.1% | |
| −48 mesh | | 41.0% | | 45.9% | |
| Total | | 56.5% | | 62.0% | |
| (b) Chemical Analysis[b] | | | | | |
| +48M: $Na_2O$ & $NaHCO_3$ | 3.4% | 9.11% | 6.6% | | 18.0% |
| −48M: $Na_2O$ & $NaHCO_3$ | 11.0% | 29.9% | 19.3% | | 52.2% |
| Total | 8.9% | 24.1% | 15.9% | | 43.0% |
| (c) Chemical Analysis[b] | | | | | |
| +48M: $Na_2O$ & $Na_2CO_3$ | 4.4% | 7.57% | 1.1% | | 1.94% |
| −48M: $Na_2O$ & $Na_2CO_3$ | 30.6% | 52.4% | 18.1% | | 31.0% |
| Total | 23.4% | 40.1% | 13.7% | | 23.5% |
| (d) % Distribution | | | | | |
| +48M: $NaHCO_3$ | | 5.2% | | 10.4% | |
| −48M: $NaHCO_3$ | | 45.6% | | 85.9% | |
| Total | 50.8% | | 96.3% | | |
| (e) % Distribution | | | | | |
| +48M: $Na_2CO_3$ | | 4.9% | | 1.3% | |
| −48M: $Na_2CO_3$ | | 90.4% | | 62.3% | |
| Total | 95.3% | | 63.6% | | |
| (f) % Distribution — $Na_2O$[c] | 76.7% | | 78.0% | | |
| Chemical Analysis-$Na_2O$ | | 32.3% | | 29.6% | |
| Chem.Anal.-$NaHCO_3$Equiv. | 87.5% | | 80.2% | | |
| (4)BRINE COMPOSITION | | | | | |
| $NaHCO_3$ g/l | | 162.50 g/l | | 162.50 g/l | |
| $Na_2CO_3.H_2O$ g/l | | 5.28 g/l | | 5.28 g/l | |
| NaCl g/l | | 1.06 g/l | | 1.06 g/l | |
| $Na_2SO_4.10H_2O$ g/l | | 12.25 g/l | | 12.25 g/l | |
| (5)METHOD-FLOTATION | Conditioning 3 min<br>Float 3 min | | | Same as No. 1 | |

[a]Cross check with flotation feed assay
[b]Corrected for brine, but not for conversion of $NaHCO_3$ to $Na_2CO_3$ during drying
[c]Corrected for brine and for drying BRINE: SATURATED $NaHCO_3$

| FLOTATION TEST NO. | | No. 3 | | | No. 4 | |
|---|---|---|---|---|---|---|
| REAGENT: TYPE | | 4-Methyl,2-Pentanol (Frother) | | | 1-Hexanol (Froth Control Agent) | |
| Lb/Ton-Float Feed | | 0.495 | | | 0.495 | |
| % SOLIDS | | 17% | | | 17% | |
| pH: Start — Finish | | 8.7 – 8.8 | | | 8.7 – 8.8 | |
| (1)HEAD (Calculated)[a] | | | | | | |
| (a) Wt.% | | 100.0% | | | 100.0% | |
| (b) Chemical Analysis[b] | | | | | | |
| % $Na_2O$ & $NaHCO_3$ | 16.3% | | 44.3% | 15.8% | | 42.9% |
| % $Na_2O$ & $Na_2CO_3$ | 5.6% | | 9.59% | 6.9% | | 11.8% |
| Total % $Na_2O$ | 21.9% | | | 22.7% | | |
| (2) FLOAT (Tails) | | | | | | |
| (a) Wt.% | | 44.3% | | | 42.2% | |
| (b) Chemical Analysis[b] | | | | | | |
| % $Na_2O$ & $NaHCO_3$ | 11.8% | | 31.9% | 11.7% | | 31.7% |
| % $Na_2O$ & $Na_2CO_3$ | 2.3% | | 4.0% | 1.7% | | 2.99% |
| Total % $Na_2O$ | 14.1% | | | 13.4% | | |
| (c) Distribution, % | | | | | | |
| $NaHCO_3$ | | 31.9% | | | 31.3% | |
| $Na_2CO_3$ | | 18.3% | | | 10.7% | |
| (d) % Distribution $Na_2O$[c] | | 28.5% | | | 24.9% | |
| (3)NON-FLOAT (Concentrate) | | | | | | |
| (a) Wt.% +48 mesh | | 12.9% | | | 14.2% | |
| −48 mesh | | 42.8% | | | 43.6 | |
| Total | | 55.7% | | | 57.8% | |
| (b) Chemical Analysis[b] | | | | | | |
| +48M: $Na_2O$ & $NaHCO_3$ | 6.7% | | 18.2% | 7.5% | | 20.4% |
| −48M: $Na_2O$ & $NaHCO_3$ | 23.9% | | 64.9% | 22.4% | | 60.9% |
| Total | 2.0% | | 54.1% | 18.8% | | 51.0% |
| (c) Chemical Analysis[b] | | | | | | |
| +48M: $Na_2O$ & $Na_2CO_3$ | 1.1% | | 1.89% | 0.3% | | 0.52% |
| −48M: $Na_2O$ & $Na_2CO_3$ | 10.4% | | 17.7% | 14.0% | | 24.0% |
| Total | 8.2% | | 14.1% | 10.6% | | 18.2% |
| (d) % Distribution | | | | | | |
| +48M: $NaHCO_3$ | | 5.3% | | | | |
| −48M: $NaHCO_3$ | | 62.8% | | | 62.0% | |
| Total | | 68.1% | | | 68.7% | |
| (e) % Distribution | | | | | | |
| +48M: $Na_2CO_3$ | | 2.5% | | | 0.6% | |
| −48M: $Na_2CO_3$ | | 79.2% | | | 88.7% | |
| Total | | 81.7% | | | 89.3% | |
| (f) % Distribution — $Na_2O$[c] | | 71.5% | | | 75.1% | |
| Chemical Analysis-$Na_2O$ | | 28.2% | | | 29.4% | |
| Chem.Anal.-$NaHCO_3$Equiv. | | 76.4% | | | 79.7% | |
| (4)BRINE COMPOSITION | | | | | | |
| $NaHCO_3$ g/l | | 162.50 g/l | | | 162.50 g/l | |
| $Na_2CO_3.H_2O$ g/l | | 5.28 g/l | | | 5.28 g/l | |
| NaCl g/l | | 1.06 g/l | | | 1.06 g/l | |
| $Na_2SO_4.10H_2O$ g/l | | 12.25 g/l | | | 12.25 g/l | |
| (5)METHOD-FLOTATION | | Same as No. 1 | | | Same as No. 1 | |

TABLE V-continued

GROUP II-A TESTS
FLOTATION FEED ASSAY: 56.9% $NaHCO_3$; 1.50% $Na_2CO_3$; 14.2Gal/Ton Shale Oil; −28 mesh (Tyler Screen)

| BRINE: SATURATED $NaHCO_3$ | | | | | | |
|---|---|---|---|---|---|---|
| FLOTATION TEST NO. | | No. 5 | | | No. 6 | |
| REAGENT: TYPE | | 1-Octanol (Froth Control Agent) | | | 1-Decanol (Froth Control Agent) | |
| Lb/Ton-Float Feed | | 0.48 | | | 0.47 | |
| % SOLIDS | | 17% | | | 17% | |
| pH: Start — Finish | | 8.7 – 8.8 | | | 8.8 – 8.8 | |
| (1)HEAD (Calculated)[a] | | | | | | |
| (a) Wt.% | | 100.0% | | | 100.0% | |
| (b) Chemical Analysis[b] | | | | | | |
| % $Na_2O$ & $NaHCO_3$ | 18.7% | | 50.8% | 16.2% | | 43.8% |
| % $Na_2O$ & $Na_2CO_3$ | 3.0% | | 5.08% | 6.2% | | 10.6% |
| Total % $Na_2O$ | 21.7% | | | 22.4% | | |
| (2) FLOAT (Tails) | | | | | | |
| (a) Wt.% | | 27.8% | | | 26.8% | |
| (b) Chemical Analysis[b] | | | | | | |
| % $Na_2O$ & $NaHCO_3$ | 10.6% | | 28.8% | 9.4% | | 25.5% |
| % $Na_2O$ & $Na_2CO_3$ | 0.9% | | 1.52% | 1.0% | | 1.72% |
| Total % $Na_2O$ | 11.5% | | | 10.4% | | |
| (c) Distribution, % | | | | | | |
| $NaHCO_3$ | | 15.8% | | | 15.6% | |
| $Na_2CO_3$ | | 8.4% | | | 4.4% | |
| (d) % Distribution $Na_2O$[c] | | 14.8% | | | 12.5% | |
| (3)NON-FLOAT (Concentrate) | | | | | | |
| (a) Wt. +48 mesh | | 13.9% | | | 15.2% | |
| % −48 mesh | | 58.3% | | | 58.0% | |
| Total | | 72.2% | | | 73.2% | |
| (b) Chemical Analysis[b] | | | | | | |
| +48M: $Na_2O$ & $NaHCO_3$ | 7.1% | | 19.3% | 5.4% | | 14.5% |
| −48M: $Na_2O$ & $NaHCO_3$ | 25.4% | | 68.7% | 22.1% | | 59.9% |
| Total | 21.8% | | 59.2% | 18.6% | | 50.5% |
| (c) Chemical Analysis[b] | | | | | | |
| +48M: $Na_2O$ & $Na_2CO_3$ | 0.6% | | 1.08% | 2.5% | | 4.25% |
| −48M: $Na_2O$ & $Na_2CO_3$ | 4.5% | | 7.73% | 9.5% | | 16.3% |
| Total | 3.8% | | 6.45% | 8.1% | | 13.8% |
| (d) % Distribution | | | | | | |
| +48M: $NaHCO_3$ | | 5.3% | | | 5.0% | |
| −48M: $NaHCO_3$ | | 78.9% | | | 79.4% | |
| Total | | 84.2% | | | 84.4% | |
| (e) % Distribution | | | | | | |
| +48M: $Na_2CO_3$ | | 2.9% | | | 6.1% | |
| −48M: $Na_2CO_3$ | | 88.7% | | | 89.5% | |
| Total | | 91.6% | | | 95.6% | |
| (f) % Distribution — $Na_2O$[c] | | 85.2% | | | 87.5% | |
| Chemical Analysis-$Na_2O$ | | 25.5% | | | 26.7% | |
| Chem.Anal.-$NaHCO_3$Equiv. | | 69.1% | | | 72.4% | |
| (4)BRINE COMPOSITION | | | | | | |
| $NaHCO_3$ | g/l | 162.50 g/l | | | 162.50 g/l | |
| $Na_2CO_3.H_2O$ | g/l | 5.28 g/l | | | 5.28 g/l | |
| NaCl | g/l | 1.06 g/l | 1.06 g/l | | | |
| $Na_2SO_4.10H_2O$ | g/l | 12.25 g/l | | | 12.25 g/l | |
| (5)METHOD-FLOTATION | | Same as No. 1 | | | Same as No. 1 | |

The table shows good separation and recovery of products. When the non-float product is screened at 48 mesh, the −48 mesh fractions were upgraded with respect to the total product, containing substantially higher $NaHCO_3$, $Na_2CO_3$, and total $Na_2O$ in the finer (−48 mesh) products (values in weight %):

| Assay | Test No. 1 | 2 | 3 | 4 | 5 | 6 |
|---|---|---|---|---|---|---|
| +48 mesh | | | | | | |
| $NaHCO_3$ | 9.11 | 18.0 | 18.2 | 20.4 | 19.3 | 14.5 |
| $Na_2CO_3$ | 7.57 | 1.94 | 1.89 | 0.52 | 1.08 | 4.25 |
| $Na_2O$ | 7.8 | 7.7 | 7.8 | 7.8 | 7.7 | 7.9 |
| −48 mesh | | | | | | |
| $NaHCO_3$ | 29.9 | 52.2 | 64.9 | 60.9 | 68.7 | 59.9 |
| $Na_2CO_3$ | 52.4 | 31.0 | 17.7 | 24.0 | 7.73 | 16.3 |
| $Na_2O$ | 41.6 | 37.4 | 34.3 | 36.4 | 29.9 | 31.6 |

The sodium values in the −48 mesh fines product range from 3 to 5 times greater than in the +48 mesh material. The +48 mesh material may be refloated, or reground to −48 mesh or smaller and refloated, with the fines non-float products combined. Of course, the float products can be combined.

Group II-B Tests.

These tests are similar to II-A tests, but the feed is substantially lower in both nahcolite and oil shale content. These tests thus represent excellent separation and recovery from a margial grade ore. The detailed parameters and results are shown in Table VI:

TABLE VI

GROUP II-B TESTS
FLOTATION FEED ASSAY: 45.5% $NaHCO_3$; 1.00% $Na_2CO_3$; 10.6 Gal/Ton Shale Oil; −28 mesh (Tyler Screen)

| BRINE:SATURATED $NaHCO_3$ FLOTATION TEST NO. | No. 7 | | | No. 8 | | |
|---|---|---|---|---|---|---|
| REAGENT: TYPE | NONE | | | Methanol (Frother) | | |
| Lb/Ton-Float Feed | None | | | 0.50 | | |
| % SOLIDS | 17% | | | 17% | | |
| pH: Start - Finish | 8.7 – 8.8 | | | 8.7 – 8.8 | | |
| (1)HEAD (Calculated)[a] | | | | | | |
| (a) Wt.% | 100.0% | | | 100.0% | | |
| (b) Chemical Analysis[b] | | | | | | |
| % $Na_2O$ & $NaHCO_3$ | 13.6% | | 36.9% | 14.4% | | 38.9% |
| % $Na_2O$ & $Na_2CO_3$ | 3.2% | | 5.46% | 2.7% | | 4.58% |
| Total % $Na_2O$ | 16.8% | | | 17.1% | | |
| (2)FLOAT (tails) | | | | | | |
| (a) Wt.% | 52.4% | | | 52.3% | | |
| (b) Chemical Analysis[b] | | | | | | |
| % $Na_2O$ & $NaHCO_3$ | 8.3% | | 22.5% | 8.1% | | 22.0% |
| % $Na_2O$ & $Na_2CO_3$ | 0.4% | | 0.62% | 0.9% | | 1.60% |
| Total % $Na_2O$ | 8.7% | | | 9.0% | | |
| (c) Distribution, % | | | | | | |
| $NaHCO_3$ | 32.1% | | | 29.6% | | |
| $Na_2CO_3$ | 5.9% | | | 18.2% | | |
| (d) % Distribution $Na_2O$[c] | 27.1% | | | 28.1% | | |
| (3)NON-FLOAT (Concentrate) | | | | | | |
| (a) Wt.% +48 mesh | 12.5% | | | 12.2% | | |
| −48 mesh | 35.1% | | | 35.5% | | |
| Total | 47.6% | | | 47.7% | | |
| (b) Chemical Analysis[b] | | | | | | |
| +48M: $Na_2O$ & $NaHCO_3$ | 3.5% | | 9.57% | 7.1% | | 19.3% |
| −48M: $Na_2O$ & $NaHCO_3$ | 25.1% | | 68.0% | 26.0% | | 70.5% |
| Total | 19.4% | | 52.7% | 21.2% | | 57.4% |
| (c) Chemical Analysis[b] | | | | | | |
| +48M: $Na_2O$ & $Na_2CO_3$ | 4.4% | | 7.59% | 0.02% | | 0.04% |
| −48M: $Na_2O$ & $Na_2CO_3$ | 7.0% | | 11.9% | 6.1% | | 10.5% |
| Total | 6.3% | | 10.8% | 4.6% | | 7.85% |
| (d) % Distribution | | | | | | |
| +48M: $NaHCO_3$ | 3.2% | | | 6.0% | | |
| −48M: $NaHCO_3$ | 64.7% | | | 64.4% | | |
| Total | 67.9% | | | 70.4% | | |
| (e) % Distribution | | | | | | |
| +48M: $Na_2CO_3$ | 17.3% | | | 0.1% | | |
| −48M: $Na_2CO_3$ | 76.8% | | | 81.7% | | |
| Total | 94.1% | | | 81.8% | | |
| (f) % Distribution - $Na_2O$[c] | 72.9% | | | 71.9% | | |
| Chemical Analysis-$Na_2O$ | 25.7% | | | 25.8% | | |
| Chem.Anal.-$NaHCO_3$Equiv. | 69.6% | | | 69.9% | | |
| (4)BRINE COMPOSITION | | | | | | |
| $NaHCO_3$ g/l | 162.50 g/l | | | 162.50 g/l | | |
| $Na_2CO_3.H_2O$ g/l | 5.28 g/l | | | 5.28 g/l | | |
| NaCl g/l | 1.06 g/l | | | 1.06 g/l | | |
| $Na_2SO_4.10-H_2O$ g/l | 12.25 g/l | | | 12.25 g/l | | |
| (5) METHOD-FLOTATION | Same as Group II-A | | | Same as No. 7 | | |

| BRINE:SATURATED $NaHCO_3$ FLOTATION TEST NO. | No. 9 | | | No. 10 | | |
|---|---|---|---|---|---|---|
| REAGENT: TYPE | 4-Methyl,2-Pentanol (Frother) | | | 1-Hexanol (Froth Control Agent) | | |
| Lb/Ton-Float Feed | 0.495 | | | 0.495 | | |
| % SOLIDS | 17% | | | 17% | | |
| pH: start - Finish | 8.7 – 8.8 | | | 8.7 – 8.8 | | |
| (1)HEAD (Calculated)[a] | | | | | | |
| (a) Wt.% | 100.0% | | | 100.0% | | |
| (b) Chemical Analysis[b] | | | | | | |
| % $Na_2O$ & $NaHCO_3$ | 14.4% | | 39.1% | 11.0% | | 29.8% |
| % $Na_2O$ & $Na_2CO_3$ | 2.3% | | 3.93 | 6.5% | | 11.1% |
| Total % $Na_2O$ | 16.7% | | | 17.5% | | |
| (2)FLOAT (Tails) | | | | | | |
| (a) Wt.% | 59.3% | | | 56.6% | | |
| (b) Chemical Analysis[b] | | | | | | |
| % $Na_2O$ & $NaHCO_3$ | 9.8% | | 26.6% | 9.3% | | 25.2% |
| % $Na_2O$ & $Na_2CO_3$ | 0.5% | | 0.81% | 0.1% | | 0.23% |
| Total % $Na_2O$ | 10.3% | | | 9.4% | | |
| (c) Distribution, % | | | | | | |
| $NaHCO_3$ | 40.3% | | | 47.6% | | |
| $Na_2CO_3$ | 12.2% | | | 1.2% | | |
| (d) % Distribution $Na_2O$[c] | 36.1% | | | 30.4% | | |
| (3)NON-FLOAT (Concentrate) | | | | | | |
| (a) Wt.% +48 mesh | 11.7% | | | 12.6% | | |
| −48 mesh | 29.0% | | | 30.8% | | |
| Total | 40.7% | | | 43.4% | | |
| (b) Chemical Analysis[b] | | | | | | |
| +48M: $Na_2O$ & $NaHCO_3$ | 8.2% | | 22.3% | 3.7% | | 9.96% |
| −48M: $Na_2O$ & $NaHCO_3$ | 26.4% | | 71.6% | 17.2% | | 46.7% |
| Total | 21.2% | | 57.4% | 13.3% | 36.0% | |
| (c) Chemical Analysis[b] | | | | | | |
| +48M: $Na_2O$ & $Na_2CO_3$ | 1.1% | | 0.18% | 4.5% | | 7.69% |
| −48M: $Na_2O$ & $Na_2CO_3$ | 6.9% | | 11.8% | 19.0% | | 32.5% |
| Total | 5.0% | | 8.49% | 14.8% | | 25.3% |

TABLE VI-continued

GROUP II-B TESTS
FLOTATION FEED ASSAY: 45.5% $NaHCO_3$; 1.00% $Na_2CO_3$; 10.6 Gal/Ton Shale Oil; −28 mesh (Tyler Screen)

| | | | | | |
|---|---|---|---|---|---|
| (d) | % Distribution | | | | |
| | +48M: $NaHCO_3$ | | 6.6% | | 4.2% |
| | −48M: $NaHCO_3$ | | 53.1% | | 48.2% |
| | Total | | 59.7% | | 52.14% |
| (e) | % Distribution | | | | |
| | +48M: $Na_2CO_3$ | | 0.5% | | 8.8% |
| | −48M: $Na_2CO_3$ | | 87.8% | | 90.0% |
| | Total | | 88.3% 98.8% | | |
| (f) | % Distribution - $Na_2O$[c] | | 63.6% | | 69.6% |
| | Chemical Analysis-$Na_2O$ | | 26.2% | | 28.1% |
| | Chem.Anal.-$NaHCO_3$Equiv. | | 71.0% | | 76.2% |
| (4)BRINE COMPOSITION | | | | | |
| | $NaHCO_3$ g/l | | 162.50 g/l | | 162.50 g/l |
| | $Na_2CO_3.H_2O$ g/l | | 5.28 g/l | | 5.28 g/l |
| | NaCl g/l | | 1.06 g/l | | 1.06 g/l |
| | $Na_2SO_4.10-H_2O$ g/l | | 12.25 g/l | | 12.25 g/l |
| (5)METHOD-FLOTATION | | | Same as No. 7 | | Same as No. 7 |
| BRINE: SATURATED $NaHCO_3$ | | | | | |
| FLOTATION TEST NO. | | | No. 11 | | No. 12 |
| REAGENT: TYPE | | | 1-Octanol (Froth Control Agent) | | 1-Decanol (Froth Control Agent) |
| Lb/Ton-Float Feed | | | 0.48 | | 0.47 |
| % SOLIDS | | | 17% | | 17% |
| pH: Start - Finish | | | 8.7 – 8.8 | | 8.7 – 8.8 |
| (1)HEAD (Calculated)[a] | | | | | |
| (a) | Wt.% | | 100.0% | | 100.0% |
| (b) | Chemical Analysis[b] | | | | |
| | % $Na_2O$ & $NaHCO_3$ | 13.2% | 35.7% | 13.8% | 37.4% |
| | % $Na_2O$ & $Na_2CO_3$ | 4.0% | 6.9% | 3.0% | 5.09% |
| | Total % $Na_2O$ | 17.2% | | 16.8% | |
| (2)FLOAT (Tails) | | | | | |
| (a) | Wt.% | | 42.9% | | 40.5% |
| (b) | Chemical Analysis[b] | | | | |
| | % $Na_2O$ & $NaHCO_3$ | 7.7% | 20.8% | 6.6% | 17.8% |
| | % $Na_2O$ & $Na_2CO_3$ | 0.5% | 0.8% | 0.7% | 1.28% |
| | Total % $Na_2O$ | 8.2% | | 7.3% | |
| (c) | Distribution, % | | | | |
| | $NaHCO_3$ | | 25.0% | | 19.3% |
| | $Na_2CO_3$ | | 5.0% | 10.2% | |
| (d) | % Distribution $Na_2O$[c] | | 24.5% | | 17.7% |
| (3)NON-FLOAT (Concentrate) | | | | | |
| (a) | Wt. % +48 mesh | | 13.0% | | 12.6% |
| | −48 mesh | | 44.1% | | 46.9% |
| | Total | | 57.1% | | 59.5% |
| (b) | Chemical Analysis[b] | | | | |
| | +48M: $Na_2O$ & $NaHCO_3$ | 5.8% | 15.6% | 4.1% | 11.1% |
| | −48M: $Na_2O$ & $NaHCO_3$ | 20.7% | 56.1% | 22.7% | 61.5% |
| | Total | 17.3% | 46.9% | 18.7% | 50.8% |
| (c) | Chemical Analysis[b] | | | | |
| | +48M: $Na_2O$ & $Na_2CO_3$ | 1.6% | 2.74% | 3.0% | 5.20% |
| | −48M: $Na_2O$ & $Na_2CO_3$ | 8.2% | 14.0% | 4.9 | 8.36% |
| | Total | 6.7% | 11.4% | 4.5% | 7.69% |
| (d) | % Distribution | | | | |
| | +48M: $NaHCO_3$ | | 5.7% | | 3.7% |
| | −48M: $NaHCO_3$ | | 69.3% | | 77.0% |
| | Total | | 75.0% | | 80.7% |
| (e) | % Distribution | | | | |
| | +48M: $Na_2CO_3$ | | 5.2% | | 12.8% |
| | −48M: $Na_2CO_3$ | | 89.8% | | 77.0% |
| | Total | | 95.0% | | 89.8% |
| (f) | % Distribution - $Na_2O$[c] | | 75.5% | | 82.3% |
| | Chemical Analysis-$Na_2O$ | | 24.0% | | 23.2% |
| | Chem. Anal.-$NaHCO_3$Equiv. | | 65.0% | | 62.9% |
| (4)BRINE COMPOSITION | | | | | |
| | $NaHCO_3$ g/l | | 162.50 g/l | | 162.50 g/l |
| | $Na_2CO_3.H_2O$ g/l | | 5.28 g/l | | 5.28 g/l |
| | NaCl g/l | | 1.06 g/l | | 1.06 g/l |
| | $Na_2SO_4.10-H_2O$ g/l | | 12.25 g/l | | 12.25 g/l |
| (5)METHOD-FLOTATION | | | Same as No. 7 | | Same as No. 7 |

[a]Cross check with flotation feed assay
[b]Corrected for brine, but not for conversion of $NaHCO_3$ to $Na_2CO_3$ during drying
[c]Corrected for brine and for drying

Group II-C Tests.

These tests employed the same head and % solids in the pulp, with a high pH equilibrium brine saturated with $Na_2CO_3$ as well as some $NaHCO_3$. Test 13 employed no agents, while test 14 used a froth control agent, the test 15 used both a cationic collector (Aeromine 3037) and a frothing agent. The detailed flow sheet of the multiple flotation steps is as follows:

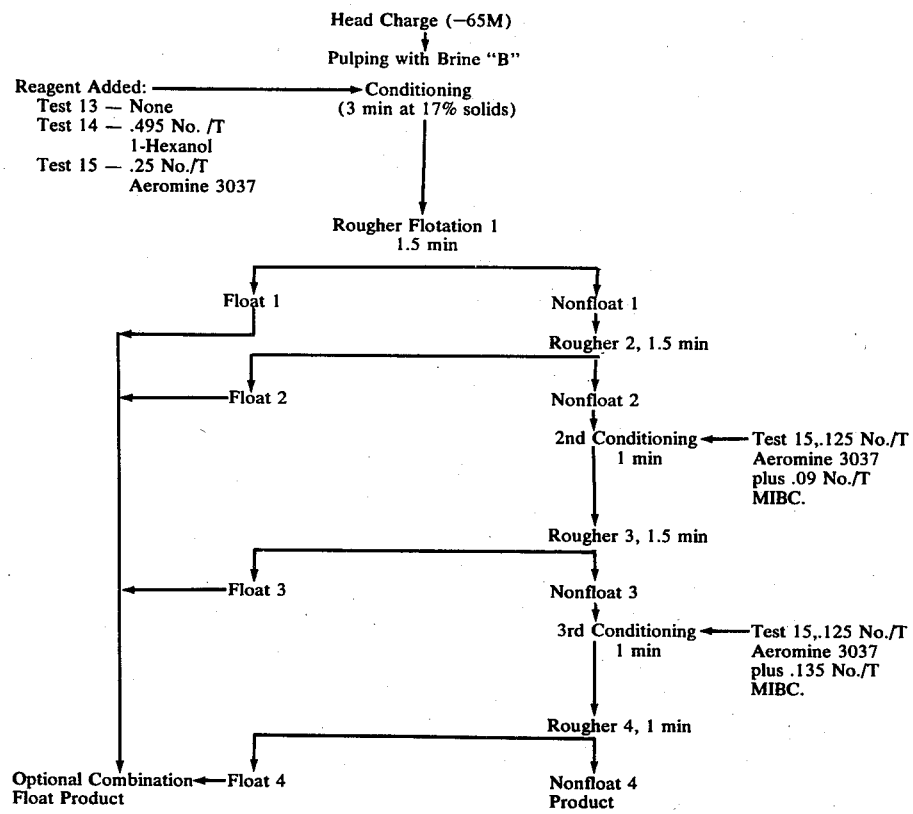

The test parameters and results are shown in Table VII below:

TABLE VII

GROUP II-C TESTS
FLOTATION FEED ASSAY: 55.9% $NaHCO_3$; 1.86% $Na_2CO_3$; 9.36 Gal/Ton Shale Oil; −65 mesh (Taylor Screen)

| BRINE: SATURATED $Na_2CO_3$ | | | | | | | |
|---|---|---|---|---|---|---|---|
| FLOTATION TEST NO. | | No. 13 | | No. 14 | | | |
| REAGENT: TYPE | | NONE | | 1-Hexanole (Froth Control Agent) | | | |
| Lb/Ton-Float Feed | | None | | 0.495 | | | |
| % SOLIDS | | 17% | | 17% | | | |
| pH: Start - Finish | | 10.3 – 10.3 | | 10.3 – 10.3 | | | |
| (1)HEAD (Calculated)[a] | | | | | | | |
| (a) Wt.% | | 100.0% | | | 100.0% | | |
| (b) Chemical Analysis[b] | | | | | | | |
| % $Na_2O$ & $NaHCO_3$ | 19.7% | 53.5% | | 18.2% | | 49.2% | |
| % $Na_2O$ & $Na_2CO_3$ | 3.0% | 5.15% | | 4.2% | | 7.21 | |
| % $SiO_2$ | | | 12.0% | | | | 12.5% |
| Total % $Na_2O$ & $SiO_2$ | 22.7% | | 12.0% | 22.4% | | | 12.5% |
| (2)FLOAT (Tails) | | | | | | | |
| (a) Wt.% | | 63.5% | | | 61.7% | | |
| (b) Chemical Analysis[b] | | | | | | | |
| % $Na_2O$ & $NaHCO_3$ | 13.5% | 36.7% | | 12.7% | | 34.5% | |
| % $Na_2O$ & $Na_2CO_3$ | 2.8% | 4.76% | 2.8% | | 4.80 | | |
| % $SiO_2$ | | | 16.7% | | | | 17.0% |
| Total % $Na_2O$ & $SiO_2$ | 16.3% | | 16.7% | 15.5% | | | 17.0% |
| (c) % Distribution | | | | | | | |
| $NaHCO_3$ | | 43.6% | | | 43.2% | | |
| $Na_2CO_3$ | | 58.7% | | | 44.0% | | |
| $SiO_2$ | | | 88.7% | | | | 83.7% |
| (d) % Distribution, $Na_2O$[c] | | 45.5% | | | 42.8% | | |
| (3)NON-FLOAT 4 Product (Concentrate) | | | | | | | |
| (a) Wt.% | | 36.5% | | | 38.3% | | |
| (b) Chemical Analysis[b] | | | | | | | |
| % $Na_2O$ & $NaHCO_3$ | 30.6% | 82.8% | 26.9% | 26.9% | | 73.0% | |
| % $Na_2$& $Na_2CO_3$ | 3.4% | 5.84% | | 6.5% | | 11.1% | |
| % $SiO_2$ | | | 5.84% | | | | 5.33% |
| Total % $Na_2O$ & $SiO_2$ | 34.0% | | 5.84% | 33.4% | | | 5.33% |
| (c) % Distribution | | | | | | | |
| $NaHCO_3$ | | 56.4% | | | 56.8% | | |
| $Na_2CO_3$ | | 41.3% | | | 56.0% | | |
| $SiO_2$ | | | 11.3% | | | | 16.3% |
| (d) % Distribution - $Na_2O$[c] | 54.5% | | | 57.2% | | | |
| Chemical Analysis-$Na_2O$ | 34.0% | | | 33.4% | | | |
| Chem.Anal.-$NaHCO_3$Equiv. | 92.1% | | | 90.5% | | | |
| (4)BRINE COMPOSITION | | | | | | | |
| $NaHCO_3$ g/l | | 15.10 g/l | | | 15.10 g/l | | |

TABLE VII-continued

GROUP II-C TESTS
FLOTATION FEED ASSAY: 55.9% $NaHCO_3$; 1.86% $Na_2CO_3$; 9.36 Gal/Ton Shale Oil; −65 mesh (Taylor Screen)

| | | | |
|---|---|---|---|
| $Na_2CO_3$ g/l | 200.40 g/l | | 200.40 g/l |
| $Na_2SO_4.10-H_2O$ g/l | 12.25 g/l | | 12.25 g/l |
| NaCl g/l | 1.06 gl | | 1.06 g/l |
| (5)METHOD-FLOTATION | See Procedure Above | | See Procedure Above |
| BRINE: SATURATED $Na_2CO_3$ | | | |
| FLOTATION TEST NO. | No. 15 | | |
| REAGENT: TYPE | Aeromine 3037 (collector) | & (frother) | MIBC |
| Lb/Ton-Float Feed | 0.50 | | 0.225 |
| % SOLIDS | | 17% | |
| pH: Start - Finish | 10.3 | — | 10.3 |
| (1)HEAD (Calculated)[a] | | | |
| (a) Wt.% | | 100.0% | |
| (b) Chemical Analysis[b] | | | |
| % $Na_2O$ & $NaHCO_3$ | 18.0% | 48.7% | |
| % $Na_2O$ & $Na_2CO_3$ | 4.9% | 8.41% | |
| % $SiO_2$ | | | 11.9% |
| Total % $Na_2O$ & $SiO_2$ | 22.9% | | 11.9% |
| (2)FLOAT (Tails) | | | |
| (a) Wt.% | | 60.2% | |
| (b) Chemical Analysis[b] | | | |
| % $Na_2O$ & $NaHCO_3$ | 10.5% | 28.4% | |
| % $Na_2O$ & $Na_2CO_3$ | 3.7% | 6.4% | |
| % $SiO_2$ | | | 17.5% |
| Total % $Na_2O$ & $SiO_2$ | 14.2% | | 17.5% |
| (c) % Distribution | | | |
| $NaHCO_3$ | | 35.3% | |
| $Na_2CO_3$ | | 46.1% | |
| $SiO_2$ | | | 89.1% |
| (d) % Distribution, $Na_2O$[c] | | 37.4% | |
| (3)NON-FLOAT 4 Product (Concentrate) | | | |
| (a) Wt.% | | 39.8% | |
| (b) Chemical Analysis[b] | | | |
| % $Na_2O$ & $NaHCO_3$ | 29.3% | 79.5% | |
| % $Na_2O$ & $Na_2CO_3$ | 6.7% | 11.4% | |
| % $SiO_2$ | | | 3.27% |
| Total % $Na_2O$ & $SiO_2$ | 36.0% | | 3.27% |
| (c) % Distribution | | | |
| $NaHCO_3$ | | 64.7% | |
| $Na_2CO_3$ | | 53.9% | |
| $SiO_2$ | | | 10.9% |
| (d) % Distribution - $Na_2O$[c] | 62.6% | | |
| Chemical Analysis-$Na_2O$ | 36.0% | | |
| Chem.Anal.-$NaHCO_3$Equiv. | 97.6% | | |
| (4)BRINE COMPOSITION | | | |
| $NaHCO_3$ g/l | | 15.10 g/l | |
| $Na_2CO_3$ g/l | | 200.40 g/l | |
| $Na_2SO_4.10-H_2O$ g/l | | 12.25 g/l | |
| NaCl g/l | | 1.06 g/l | |
| (5)METHOD-FLOTATION | | See Procedure Above | |

[a]Cross check with flotation feed assay
[b]Corrected for brine, but not for conversion of $NaHCO_3$ to $Na_2CO_3$ during drying
[c]Corrected for brine and for drying This test group shows use of a high pH, $Na_2CO_3$-rich brine with a particular ore producing excellent separation and recovery, both with and without additives.

In all the tests a constant temperature of 70°F and 93% relative humidity was used. Air was the gas phase in all tests, although $CO_2$ and other gases may be used.

It should be understood that various modifications within the scope of this invention can be made by one of ordinary skill in the art without departing from the spirit thereof. We therefore wish our invention to be defined by the scope of the appended claims as broadly as the prior art will permit, and in view of this specification if need be.

We claim:

1. A froth flotation process comprising the steps of:

a. providing an ore comprising kerogen-containing rock and authigenic sodium mineralization, said sodium mineralization including:
   i. dawsonite, and
   ii. nahcolite, trona, corresponding sodium compounds, and mixtures thereof, b. crushing said ore to a size that provides liberation therefrom trona, corresponding sodium compounds and mixtures thereof of said nahcolite without liberating from said rock substantial amounts of kerogens, c. said crushing step produces a head of said kerogen-containing rock having said sodium mineralization commingled therewith, d. pulping said head in an aqueous brine solution, e. said aqueous brine solution contains sodium cations and carbonate anions selected from $CO_3^{=}$, $HCO_3^-$, and mixtures thereof, f. said brine having a pH above about 7.0, and being substantially devoid of $Cl^-$ anions contributed by other than said head, g. contacting said pulped head-brine mixture with a gas to form a froth, h. collecting a portion of said kerogen-containing rock and said dawsonite mineralization in a first float portion, i. collecting a portion of said nahcolite, trona, corresponding sodium compounds, and mixtures thereof in a second, non-float portion, thereby effecting a separation of said kerogen-containing rock from said nahcolite, trona, corresponding sodium compounds, and mixtures thereof mineralization.

2. A process as in claim 1 wherein said pH is between about 8.0 to 12.0.

3. A process as in claim 2 wherein said brine pH ranges between about 8.3 – 10.7 with respect to said sodium cations and carbonate anions.

4. A process as in claim 2 which includes the steps of separating said crushed ore into an oversize fraction and a fines fraction, providing said fines fraction as said head, said separation size being selected in relation to the liberation size of said sodium mineralization.

5. A process as in claim 4 wherein said liberation size is below about 6 mesh.

6. A process as in claim 1 wherein said kerogen-containing rock is an ore comprising raw oil shale, retorted oil shale, and mixtures thereof.

7. A process as in claim 6 wherein said ore is reduced to a size below about 6 mesh during said crushing.

8. A process as in claim 7 wherein said size reduction includes passing said ore through an impact-type size reduction appartus.

9. A process as in claim 1 wherein brine ions are derived from sodium carbonate, sodium bicarbonate, and mixtures thereof.

10. A process as in claim 1 which includes the step of separating said non-float portion into a large fraction and a small fraction having a mesh size below about 6 mesh, and said –6 mesh fraction is recovered as a product rich in sodium values.

11. A process as in claim 1 which includes the step of adding to said brine a froth agent selected from a froth control agent, a frother, and mixtures thereof.

12. A process as in claim 11 wherein said froth agent is selected from methanol, 4methyl-2-pentanol, 1-hexanol, 1-octanol, 1-decanol, pine oil, cresylic acid, a water soluble higher aliphatic alcohol, and mixtures thereof.

13. A process as in claim 1 wherein said process includes a step of conditioning said pulp by contacting said pulp with a conditioning agent.

14. A process as in claim 13 wherein said step of adding a conditioning agent includes adding a froth agent selected from a frother, a froth control agent, and mixtures thereof.

15. A process as in claim 14 wherein the amount of said froth agent ranges from 0–10 lbs/ton of head.

16. A process as in claim 13 which includes a plurality of conditioning steps.

17. A process as in claim 16 wherein a froth agent selected from a frother, a froth control agent, and mixtures thereof, is added during at least one of said conditioning steps.

18. A process as in claim 17 wherein different froth agents are added during different conditioning steps.

19. A process as in claim 1 which includes at least one step of cleaner flotation.

20. A process as in claim 19 which includes at least one step of scavenger flotation.

21. A process as in claim 1 which includes at least one step of scavenger flotation.

22. A process as in claim 1 which includes a plurality of rougher flotation stages.

23. A proccess as in claim 1 which includes at least one rougher flotation step in combination with at least one step selected from pulp conditioning, cleaner flotation, scavenger flotation, and combinations of said steps.

24. A process as in claim 1 which includes the step of adding a collector to said pulped brine.

25. A process as in claim 24 wherein the amount of said collector agent ranges from 0–20 lbs/ton of head.

26. A process as in claim 24 wherein said collector is selected from cationic organic compounds, anionic organic compounds, and mixtures thereof, and said compounds are selective to said rock or components therein.

27. A process as in claim 26 wherein said collector and said froth agent are added separately or in combination during at least one pulp conditioning step.

28. A process as in claim 27 which includes said addition step in combination with at least one step selected from a rougher flotation step, a cleaner flotation step, a scavenger flotation step, and combinations of said steps.

29. A process as in claim 1 wherein both a collector and a froth agent are added to said brine.

30. A process as in claim 1 wherein said gas is selected from air, $CO_2$ and an inert gas.

31. A process as in claim 1 wherein said solids content of said pulp ranges from 1–40 weight %.

32. A process as in claim 1 wherein said kerogen-containing rock ranges up to 95 g/T shale oil, and said sodium mineralization comprises nahcolite ranging in assay up to about 95 weight % $NaHCO_3$, dawsonite in assays of up to 30 weight % $NaAlCO_3(OH)_2$, or mixtures of nahcolite and dawsonite.

33. A process as in claim 1 wherein said second non-float portion is rich in nahcolite.

34. A process as in claim 1 wherein said second non-float portion is rich in sodium carbonate.

35. A process as in claim 1 which includes the added step of drying the non-float portion.

36. A process as in claim 35 wherein said drying includes heating the non-float portions to convert substantially all $NaHCO_3$ to $Na_2CO_3$.

* * * * *

UNITED STATES PATENT AND TRADEMARK OFFICE

CERTIFICATE OF CORRECTION

PATENT NO. : 3,973,734

DATED : August 10, 1976

INVENTOR(S) : Rosar et al.

It is certified that error appears in the above-identified patent and that said Letters Patent are hereby corrected as shown below:

Abstract, line 5, "bicarboate" should read --bicarbonate--.

Column 2, line 38, "dowsonite" should read --dawsonite--.

Column 3, line 33, "forth" should be --froth--.

Column 5, line 11, "alson" should be --alone--.

Column 7, line 39, "na6$Mg_2(CO_3)_4(SO_4)$" should read --$Na_6Mg_2(CO_3)_4(SO_4)$--.

Column 7, line 63, second occurrence of "head" should read --feed--.

Column 9, line 55, "20%" should be deleted.

Column 12, line 2, "NaCL" should read --NaCl--.

Column 15, Table II, under (1)(b), the superscript "Analysis" should read superscript --b--.

Column 15, Table II, under (1)(b), the phrase "Total & $Na_2O$" should read --Total % $Na_2O$--.

Column 24, line 38, the second occurrence of "of" should read --or--.

Column 26, under Flotation Test No. 4, (3)(d), +48M: $NaHCO_3$, please insert --6.7%--.

Column 35, line 68, after "therefrom" please insert --of said nahcolite,--.

UNITED STATES PATENT AND TRADEMARK OFFICE

CERTIFICATE OF CORRECTION

PATENT NO. : 3,973,734

DATED : August 10, 1976

INVENTOR(S) : Rosar et al.

It is certified that error appears in the above-identified patent and that said Letters Patent are hereby corrected as shown below:

Column 36, line 47, after "thereof" please delete --of said nahcolite--.

Column 37, line 36, "4methyl-2-pentanol" should read --4-methyl-2-pentanol--.

Signed and Sealed this

Third Day of May 1977

[SEAL]

*Attest:*

RUTH C. MASON
*Attesting Officer*

C. MARSHALL DANN
*Commissioner of Patents and Trademarks*